US005426488A

United States Patent [19]

Hayakawa et al.

[11] Patent Number: 5,426,488

[45] Date of Patent: Jun. 20, 1995

[54] METHOD OF CHARGING A BUILT-IN ELECTROPHOTOGRAPHIC CHARGE MEMBER

[75] Inventors: Takashi Hayakawa, Kyoto; Kenji Tani, Yamatokoriyama; Katsumi Adachi, Nara, all of Japan

[73] Assignee: Sharp Kabushiki Kaisha, Osaka, Japan

[21] Appl. No.: 135,632

[22] Filed: Oct. 14, 1993

[30] Foreign Application Priority Data

| | | | |
|---|---|---|---|
| Oct. 19, 1992 | [JP] | Japan | 4-306055 |
| Dec. 11, 1992 | [JP] | Japan | 4-331626 |
| Jan. 13, 1993 | [JP] | Japan | 5-003648 |
| Feb. 23, 1993 | [JP] | Japan | 5-033334 |

[51] Int. Cl.[6] ..... G03G 15/02

[52] U.S. Cl. ..... 355/219; 361/225

[58] Field of Search ..... 355/208, 219; 361/220, 361/221, 225, 230

[56] References Cited

U.S. PATENT DOCUMENTS

| | | | |
|---|---|---|---|
| 4,455,078 | 6/1984 | Mukai et al. | 355/219 |
| 4,494,857 | 1/1985 | Ueno et al. | 355/219 |
| 5,287,152 | 2/1994 | Oka et al. | 355/219 X |
| 5,305,061 | 4/1994 | Takama et al. | 355/219 |
| 5,323,215 | 6/1994 | Ohtaka et al. | 355/219 X |

FOREIGN PATENT DOCUMENTS

| | | |
|---|---|---|
| 5-529837 | 3/1980 | Japan . |
| 5-691253 | 7/1981 | Japan . |
| 5-613256 | 10/1981 | Japan . |
| 5-840566 | 9/1983 | Japan . |
| 60-216361 | 10/1985 | Japan . |
| 60-220587 | 11/1985 | Japan . |
| 62-143072 | 6/1987 | Japan . |
| 3-100674 | 4/1991 | Japan . |
| 3-100675 | 4/1991 | Japan . |
| 3-101764 | 4/1991 | Japan . |
| 3-52058 | 8/1991 | Japan . |
| 3-101765 | 9/1991 | Japan . |
| 4-16867 | 1/1992 | Japan . |

*Primary Examiner*—Robert B. Beatty
*Assistant Examiner*—William J. Royer

[57] ABSTRACT

A charging member comprised of a conductive shaft and conductive fibers planted thereon is brought into contact with a charged member with a photoconductor provided on the surface thereof. The conductive shaft is applied with a combined voltage of d.c. voltage and a.c. voltage having a peak-peak value lower than two times the discharge starting threshold voltage that is determined by the surrounding atmosphere around the charged member. While the charging member and the charged member rotate at different surface velocity, the charged member is charged through the contact area in which impedance is low due to the influence of a.c. voltage, so that a stable surface potential close to the d.c. voltage may be charged onto the charged member. Further, it is effective that the frequency f of the a.c. voltage will be so set up as to suffice a relation: $f > Vp/2R$, where f is a frequency of the applied a.c. voltage, Vp(mm/s) is a moving velocity of the charged member, and R(mm) is a particle size of a developer used. Moreover, it is effective that another charging member is provided on the downstream side of the aforementioned charging member.

13 Claims, 14 Drawing Sheets

METHOD OF CHARGING A BUILT-IN ELECTROPHOTOGRAPHIC CHARGE MEMBER

BACKGROUND OF THE INVENTION

1. Field of the Invention

The present invention relates to a method of charging, and more specifically relates to a method of charging for a charging device that charges an electrophotographic charged member built in photocopiers, printers and the other image-forming apparatuses employing the electrophotographic process.

2. Description of the Related Art

In image forming apparatuses using so called electrophotographic process (Carlson process), corona charging devices that utilizes the corona discharge phenomenon have been used as typical means for charging an electrophotographic photoconductor at a desired potential. This method, however, requires a high voltage for causing discharge, which in turn would give electric noises to various peripheral apparatuses. Alternatively, a large quantity of ozone gas that will be generated in discharging would give an unpleasant feeling to people around the machine. To deal with these problems, as alternatives to corona discharging devices, a method has been proposed in which a photoconductor is charged by applying a voltage between the photoconductor and a roller made of conductive resin or a conductive fabric. Nevertheless, this method suffers from another problem. That is, in use of a conductive resin roller, if a micro-area of a photoreceptive layer on the photoconductor to be charged was peeled off to partially expose a conductive substrate such as aluminum, etc., electric current from the roller would converge into the exposed portion, to thereby cause striped charging unevenness extending across the photoconductor in its axial direction.

Specifically, the alternative to the corona charging devices, there has been proposed an electrophotographic contact charging method in which, as shown in FIG. 1, a voltage is applied between an image bearing medium, i.e., photoconductor 1 and a resin roller 65 as contacting member, made of a conductive elastic material, so as to charge photoconductor 1, by bringing resin roller 65 into contact with photoconductor 1.

Another method has been disclosed in, for example, Japanese Patent Application Laid-Open Sho 55 No. 29,837, etc.

FIG. 2 is a perspective view showing an example of the electrophotographic charging device. Here, reference numeral 1 designates a charged member or a photoconductor. The charging device has a charging member which is planted with conductive fabric 75*a* as contact element to a conductive substrate 75*b* made of aluminum, etc., and to which a voltage is applied by an unillustrated power supply. Charging of photoconductor 1 is performed by bringing the voltage-applied conductive fabric 75*a* into contact with photoconductor 1 while the photoconductor to be charged is being rotated.

This charging operation must be performed at the first stage of the image forming process. After having been charged, photoconductor 1 is exposed to light in accordance with image information, bears toner and then transfers the toner-developed image to a transfer material. The toner powder left on photoconductor 1 without having been transferred is removed from photoconductor 1 in a cleaning portion after the transferring step, thus, a series of the image forming procedures is complete.

In spite of the cleaning operation of photoconductor 1 by the cleaning unit, some toner particles can not be removed and may be left on photoconductor i since toner particles are scattered inside the image forming apparatus after a long use. In such cases, the toner particles unremoved are nipped between the contact element and the image supporting medium during the charging operation. The occupation by the toner particles unremoved would inhibit contact between the contact element and the image supporting medium, thus giving rise to a problem that the image supporting medium may not be charged uniformly.

The types of charging devices that use conductive fabric can be generally divided into two classes. That is, fabric is planted like a band in one class, whereas fabric is planted in a roller shape in the other. In either case, the striped charging unevenness can be eliminated which would occur if the conductive resin roller was used. Nevertheless, when a d.c. voltage is applied to the charging member, in other word when a d.c. electric field is generated between the charging member and the photoconductor, no stable charging performance can be obtained because the photoconductor tends to be charged at a higher potential when the system is placed in an high temperature, high humidity environment as compared to when it is in a normal temperature, normal humidity environment. Further, the charging potential in the charger tends to gradually decrease from the start of use, and the variation with the passage of time is too large to bring the device into practical use.

To eliminate the problem caused in the case where only d.c. voltage is applied, a method has been proposed in which an a.c. voltage is superposed or combined to the d.c. voltage.

In disclosures "A Brush Charging and Transferring Device" and "A Brush Charging Device" respectively published in Japanese Patent Application Laid-Open Sho 60 No. 216,361 and Sho 60 No. 220,587, a charging method is described in which a charging member abutted sharing a contact area with a charged member is applied by a combined voltage of d.c. voltage and a.c. voltage.

In Japanese Patent Application Laid-Open Sho 60 No. 216,361, a member made of conductive fabric is used as both the charging member and the transferring member, and the voltages to be combined are defined by the requirements of transfer efficiency and charging uniformity. Specifically, the transfer efficiency limits a combine voltage to fall within a range of 200 to 2 kV. Therefore, when a high d.c. voltage, for example, 1500 V is applied, the a.c. voltage should be limited as low as 200 to 500 V by the requirement of the transfer efficiency and the charging uniformity.

In Japanese Patent Application Laid-Open Sho 60 No. 220,587, the a.c. voltage is specified as low as 300 VRMS, and the amplitude of the a.c. voltage should be 20% or more of the magnitude of the d.c. voltage. Therefore, the d.c. voltage has influence as high as 2,000 V, which is far higher than the desired surface potential. Besides, the frequency of a.c. voltage to be superposed is limited to 500 Hz or more, and the superposition of the a.c. voltage is intended to eliminate the charging failure (striped charging unevenness) caused by regions at which no fabric exists in the charger of the conductive fabric.

Japanese Patent Application Laid-Open Sho 58 No. 40,566 discloses a proposal in which a conductive fabric is formed into a roll-shaped member to be rotated as a charging member, and rotational direction and velocity of the roller are selected.

This disclosure describes that, when a cylindrical, zinc oxide charged member, used as a charged body, is put in parallel contact (in axial direction) with a band-shaped charger, the surface potential of the zinc oxide charged member lowers under a low temperature, low humidity environment. This lowering of the potential is accompanied by a line-shaped image defect. The above disclosure is to eliminate the lowering of the surface potential and the line-shaped image defect. The problem was attributed to a charging phenomenon of the conductive fabric (described in the right, lower column on the third page in Japanese Patent Application Laid-Open Sho 58 No. 40,566.)

Japanese Patent Application Laid-Open Sho 60 No. 220,587 as well as Japanese Patent Application Laid-Open Sho 60 No. 216,361 discloses a method of charging in which a charging member made of a conductive fabric is used to charge a charged member by bringing the charging member into contact with the charged member. Neither of the disclosures, however, make any reference to a charging mechanism of the charging method thereof, to say nothing of the cause and measure of voltage variation due to the charging mechanism. In both disclosures, a relatively low a.c. voltage is superposed over a very high d.c. voltage, e.g., 2,000 V, and particularly, in Japanese Patent Application Laid-Open Sho 60 No. 220,587, a frequency of the a.c. voltage is limited to 500 Hz or more.

The types of charging devices that use conductive fabric can be generally divided into two classes. That is, fabric is planted like a band in one class, whereas fabric is planted in a roller shape in the other. In either case, the stripe-shaped charging unevenness can be eliminated which would occur when the conductive resin roller is used. Nevertheless, when a d.c. current is applied to the charging member, in other words when a d.c. electric field is generated between the charging member and the charged member, stable charging characteristics cannot be obtained because the charged member tends to be charged to a higher potential when the charged member is in an high temperature environment with a high humidity as compared to when it is in a normal temperature environment with a normal humidity. Further, the charging potential in the charging member tends to gradually decrease from the start of use, and the variation with the passage of time is too large to bring the device into practical use.

Thus, various proposals have been made, but all of these could not exclude insufficiency of stability of surface potential. Further, if no consideration is given to the frequency of an a.c. voltage applied, ripples due to the applied a.c. voltage may be overlaid on the charged voltage, and this would on occasions cause a new defect, i.e., unevenness on the image.

Now, consider a case in which a charged member (in this case, an electrophotographic photoconductor) will be charged by using any one of charging members composed of conductive fabric or a conductive fiber aggregation. In this case, the charging member and the charged member are placed opposite to each other sharing a contact point and micro-space therebetween while the charging member being applied with a combination of d.c. and a.c. voltages.

FIGS. 3A and 3B are schematic illustrative views showing a charging mechanism when a photoconductor is impressed by a combination of d.c and a.c. voltages using a charging member made of conductive fabric. Of these, FIG. 3A shows an overall configuration and FIG. 3B is an enlarged view partially showing the vicinity of a contact area. In FIGS. 3A and 3B, reference numeral 1 designates a photoconductor as a charged member, and a charger is designated at 5, on which conductive fibers 5A are planted or adhered.

Referring to FIGS. 3A and 3B, in a case where a tip of a fiber 5A to which a voltage is applied is located opposite to an arbitrary point A on photoconductor 1 while keeping a certain distance, if the applied voltage is greater than a discharge starting threshold voltage (Vth) which is determined depending upon characteristics of photoconductor 1 and the gap, discharge is activated to start charging photoconductor 1. The surface potential (Vsp) will continue to rise until a difference between the applied voltage (Vap) and the surface potential (Vsp) becomes equal to the discharge starting threshold voltage (Vth). When this condition is satisfied, the discharge stops. That is, if the dark attenuation of the potential charged on the photoconductor could be neglected, the relation $(Vsp)=(Vap)-(Vth)$ holds. Then, point A being kept at a certain potential charged, passes out from the area in which discharge is allowed, and moves to a position B where point A comes in contact with conductive fiber 5A. The potential difference between conductive fiber 5A and point A on photoconductor 1 at position B must be, of course, (Vth) as apparent from above. This potential difference causes charges to inject (move) from conductive fiber 5A into point A on photoconductor 1 so as to further increase the potential at point A. In one word, the surface potential is supplied by the combination of discharge effect and charge-injection effect.

The amount of charges injected by the contact is determined depending upon the contact resistance at position B, which in turn depends on the condition of the contact surface. If, for instance, the contact surface is in a high humidity environment and holds moisture thereon, the contact resistance lowers sharply so that the amount of charges injected becomes large. As a result, the surface potential will rise. This mechanism is believed to be a main reason why characteristic of surface potential in this charging method is unstable depending upon environment.

As a means to solve the problem, a proposal has been made in, for example, Japanese Patent Application Laid-Open Sho 56 No. 132,356, in which a constant current power supply is used as a power source for application to a charging member. This method, however suffers from the charge-up problem since current continuously flows through the charging member.

Japanese Patent Publication Hei 3 No. 52,058 describes a proposal for the purpose of uniformalizing surface potential in the similar contact charging method using a charging member and a charged member. However, the charging member used here is limited to roller-shaped or pad-shaped members made of rubbers, and no reference is made to members with conductive fibers planted thereon. According to the disclosure, it is described that when the charging member is applied with a d.c. voltage, the charging process starts above a discharge starting threshold voltage that is determined by Paschen's theory. That is, it can apparently be assumed and understood from the description of the proposal that all the charging is effected only by the discharging and no movement of charges at and through the contact point between the charging member and the charged member occurs. Therefore, a relatively high a.c. voltage that is equal to a charging starting voltage and is two times as high as the discharge starting threshold voltage, is applied between the two members, so that the surface potential may be uniformalized (particularly, spot-shaped charging unevenness can be inhibited) by utilizing discharge effect.

Further, there are several proposals connected with the contact charging method using a charging member and a charged member. These proposals include Japanese Patent Application Laid-Open Hei 3 No. 100,674, Japanese Patent Application Laid-Open Hei 3 No. 100,675, Japanese Patent Application Laid-Open Hei 3 No. 101,764 and Japanese Patent Application Laid-Open Hei 3 No. 101,765. All these applications employ similar charging methods as described in Japanese Patent Publication Hei 3 No. 52,058, and are proposed to limit the frequency of the a.c. charging in order to eliminate unevenness occurring in the development.

The limitations of the frequency described in Japanese Patent Application Laid-Open Hei 3 Nos. 100,674 and 100,675 are to reduce vibration noises caused by the application of a.c. voltage and to increase the number of discharge in the posterior discharge region so as to smooth jaggedness in the surface potential and improve uniformity of the surface potential. In these technologies, the frequency is specified to be 1,000 Hz or less in Japanese Patent Application Laid-Open Hei 3 No. 100,674. The specific frequency in Japanese Patent Application Laid-Open Hei 3 No. 100,675 is 1,000 Hz or less and 2,500 Hz or more, and more preferably 10 Hz or less and 10,000 or more. These ranges are quite different from the frequency range that will be specified later in the present invention.

Repeatedly, Japanese Patent Application Laid-Open Hei 3 No. 100,674 uses the same charging method described in Japanese Patent Publication Hei 3 No. 52,058, and is to reduce unevenness on images caused by the charging unevenness due to influence of variation of the power supply, etc., by limiting frequency of the a.c. charging.

Basically, the techniques described above are to increase sufficiently the number of charge-exchanges caused by virtue of discharging effect so as to smooth the jaggedness of the surface potential, to thereby eliminate image-unevenness. On the other hand, in the charging by the charging member of conductive fabric as exemplified above, both the charge-injection and the discharge effect contribute to the charging mechanism. This charging mechanism can also be applied to the charging member of resin material as found in the prior art if conditions are fitted.

In the charging system based on the mechanism, if an a.c. voltage is applied to such a charging system, it can be easily conceived that the a.c. component may be superposed through the charge-injection on the surface potential. Of course, the possibility cannot be completely negated that an a.c. component applied might be superposed through the discharge effect on the surface potential. Any way, the defect must apparently be attributed to the a.c. voltage applied. Actually, on the final image created by the method appear repeated defects in coincidence with the interval calculated from the process speed and the a.c. frequency.

To sum up, there are two cases for generating a surface potential as follows:

a first case is that a surface potential is generated only through discharge effect; and A second case is that a surface potential is generated through combination of discharge effect and charge-injection effect. In this case, for example, the charging is effected while a charging member made of conductive fabric and a photoconductor share a contact point and micro-space therebetween. In either case, if charging is effected by a single charging member applied by at least one a.c. voltage, periodic image defects appearing on a final image must be attributed to the a.c. voltage applied.

In order to eliminate image defects due to a.c. voltage, another method has been proposed that differs from the methods described above. Specifically, one or more (at least one) separate charging members (which will be called secondary charging members) are disposed between the previously adopted charging member (which will be called a first charging member) and a developing unit, so that ripples in the surface potential caused by the a.c. voltage applied by the first charging member are eliminated by the secondary charging member or members.

Some disclosures have already been proposed which relate to the charging method in which a plurality of charging members are put in contact with a photoconductor to be charged. Namely, they are Japanese Patent Application Laid-Open Sho 56 No. 91,253 Japanese Patent Application Laid-Open Sho 62 No. 143,072 and Japanese Patent Application Laid-Open Hei 4 No. 16,867.

Of these, a problem referred to in Japanese Patent Application Laid-Open Sho 56 No. 91,253 is the occurrence of damages to the photoconductor, which is attributed in the disclosure to the fact that the photoconductor is charged by the charging member abruptly all at once. Accordingly, a main measure against the problem taken by the invention is that an applied d.c. voltage to a first charging member is set up as low as 200 volts, and d.c. voltages are stepped up from the first through a second to a third charging member. A peak-peak value of the a.c. voltage superposed on a d.c. voltage is limited to 20% or less of the d.c. voltage. Specifically, the peak-peak value of the a.c. voltage applied to the first charging member is as low as $200\times0.2=40$ (V) or less. This publication proposes that the final, third charging member should also be superposed with an a.c. voltage.

A Problem referred to in Japanese Patent Application Laid-Open Sho 62 No. 143,072 is the same with that described in Japanese Patent Application Laid-Open Sho 56 No. 91,253. A main measure against the problem taken by the invention is that the greatest electric resistance is allotted to a first charging member, and the resistance values are reduced step by step through a second to a third charging member. By this arrangement, the potential charged to a photoconductor from the first charging member would be regulated at low level like Japanese Patent Application Laid-Open Sho 56 No. 91,253 so as to prevent the damages to the photoconductor.

Correction of ununiformity of the surface potential due to a.c. voltages applied is a target problem to be solved by Japanese Patent Application Laid-Open Hei 4 No. 16,867. The main feature of the invention disclosed in Japanese Patent Application Laid-Open Hei 4 No.

16,867 is that a.c. voltages that differ in phase one another are applied to a first charging member and a secondary member or members, respectively, so as to correct the ununiformity of the surface potential. Also in this proposal, the final, secondary charging member is to be superposed with an a.c. voltage.

The present inventors have further proceeded to carry out experiments intensively using the just mention prior art means in which the second charging member is provided in addition to the first charging member so as to produce a possible correction effect. As the result of the experiments the following fact was confirmed. That is, in a system including a typical organic photoconductor and charging members made of a conductive resin, as a peak-peak value of an a.c. voltage applied to the first charging member increases up to two times as high as the discharge starting threshold voltage, the a.c. voltage component injected into the photoconductor becomes greater. This naturally requires the voltage applied to a second charging member for the correction to be enhanced. To make matters worse, the resultant surface potential cannot be regulated by the d.c. voltage applied to the first charging member, but becomes large in accordance with increment of the peak-peak value of the a.c. voltage.

SUMMARY OF THE INVENTION

It is therefore an object of the present invention to provide an image forming means in which unevenness on an image is eliminated, a stable surface potential of a charged member is maintained and generation of ozone gas is reduced, and to provide an electrophotographic charging method including a charging system sharing at least a contact area with the charged member for eliminating ununiformity of a surface potential distribution brought about when an a.c. voltage is applied to the charged member.

The present invention has been achieved in order to attain the above object, the gist of the present invention will be described as follows.

A first gist of the present invention resides in that an electrophotographic charging method used for an image forming apparatus including a charging system, wherein the charging system comprises: a charged member; a charging member with a conductive fabric or an aggregation of conductive fibers planted thereon, facing, and abutting against, the charged member so as to create a contact area and micro-space between the charged member and the charging member; and a power source for applying a voltage to the charging member, and charging of the charged member is effected at least through discharge effect via the micro-space and charge injection effect via the contact area, the method comprises the steps of:

generating a combined voltage of d.c. and a.c. voltages in the power source; and applying the combined voltage to the charging member, and is characterized in that the absolute value of a difference between a surface potential of the charged member and a value of the combined voltage when the absolute value of the combined voltage takes its minimum value is smaller than a discharge starting threshold voltage that is determined by the characteristics of the charged member and the atmosphere surrounding the system.

A second gist of the present invention lies in an electrophotographic charging method used for an image forming apparatus including a charging system, wherein the charging system comprises: a charged member; a charging member with a conductive fabric or an aggregation of conductive fibers planted thereon, facing, and abutting against, the charged member so as to create a contact area and micro-space between the charged member and the charging member; and a power source for applying a voltage to the charging member, and charging of the charged member is effected at least through discharge effect via the micro-space and charge injection effect via the contact area, the method comprises the steps of:

generating a combined voltage of d.c. and a.c. voltages in the power source; and applying the combined voltage to the charging member, and is characterized in that a frequency f of the a.c. voltage is so set up as to suffice a relation:

$$f > Vp/2R$$

where f is a frequency of the applied a.c. voltage; Vp(mm/s) is a moving velocity of the charged member as a processing speed of the image forming apparatus; and R(mm) is a particle size of a developer used in the image forming apparatus.

A third gist of the present invention resides in that an electrophotographic charging method used for an image forming apparatus including a charging system, wherein the charging system comprises: a charged member; a charging member with a conductive fabric or an aggregation of conductive fibers planted thereon, facing, and abutting against, the charged member so as to create a contact area and micro-space between the charged member and the charging member; and a power source for applying a voltage to the charging member, and charging of the charged member is effected at least through discharge effect via the micro-space and charge injection effect via the contact area, the method comprises the steps of:

generating a combined voltage of d.c. and a.c. voltages in the power source; and applying the combined voltage to the charging member, and is characterized in that the voltage applied to the charging member is applied through the fibers and is equal to or higher than a discharge starting threshold voltage, and the outer diameter of the fiber is greater than the particle size of the toner particle used.

A fourth gist of the present invention resides in that an electrophotographic charging method used for an image forming apparatus including a charging system, wherein the charging system comprises: a charged member; a charging member with a conductive fabric or an aggregation of conductive fibers planted thereon, facing, and abutting against, the charged member so as to create a contact area and micro-space between the charged member and the charging member; and a power source for applying a voltage to the charging member, and charging of the charged member is effected at least through discharge effect via the micro-space and charge injection effect via the contact area, the method comprises the steps of:

generating a combined voltage of d.c. and a.c. voltages in the power source; and applying the combined voltage to the charging member, and is characterized in that the charging system further comprises: a resistance detecting means for detecting resistance value of the charging member; and a voltage controlling means for controlling the voltage applied to the charging member based on the resistance value detected in the resistance detecting means, and the voltage controlling means comprises a converting means for converting the resistance value detected in the resistance detecting means into a voltage information signal and a voltage selecting means for selecting a voltage to be applied to the charging member from a plurality of preset voltages.

A fifth gist of the present invention lies in that an electrophotographic charging method used for an image forming apparatus including a charging system, wherein the charging system comprises: a charged member; a charging member with a conductive fabric or an aggregation of conductive fibers planted thereon, facing, and abutting against, the charged member so as to create a contact area and micro-space between the charged member and the charging member; and a power source for applying a voltage to the charging member, and charging of the charged member is effected at least through discharge effect via the micro-space and charge injection effect via the contact area, the method comprises the steps of:

generating a combined voltage of d.c. and a.c. voltages in the power source; and applying the combined voltage to the charging member, and is characterized in that the charging member is used as a first charging member, and further at least one secondary charging member or members to which a d.c. voltage is applied are further provided on the down stream side of the first member.

In any of features described above, the following characteristics are effective:

a peak-peak value of the voltage supplied from the power source is smaller than two times of a discharge starting threshold voltage that is determined by the characteristics of the charged member and the atmosphere surrounding the system;

the d.c. voltage is equal to a desired surface potential of the charged member, or in a case where a secondary charging member or members are provided, the d.c. voltage is equal to a desired surface potential of the charged member and the d.c. voltage applied to the secondary charging member or members is equal to or more than the d.c. voltage applied to the first charging member;

a frequency of the a.c. voltage is so set up as to apply the combined voltage to the charged member oscillating at least in one period of the a.c. voltage within a span of time in which each part of the charged member keeps contact with the charged member; and a time Tc during which each part of the charged member comes in contact with the charging member in one revolution of the charged member suffices a relation:

$$1/f \leqq Tc$$

where f is a frequency of the a.c. voltage applied to the charging member.

In addition, in the case where the secondary charging member or members are provided, it is effective that the contact area between the secondary charging member or members and the charged member is larger than the contact area between the first charging member and the charged member.

Moreover, in any of features described above, the following characteristics are effective:

the charging member is constructed in a form of a band or roller on which a conductive fabric or an aggregation of fibers is planted;

the charging member is constructed in a form of a roller on which a conductive fabric or an aggregation of fibers is planted and rotates at a peripheral velocity not equal to a moving velocity of the charged member; and the charging member is constructed in a form of a band on which a conductive fabric or an aggregation of fibers is planted and vibrates in a direction unparallel to a moving direction of the charged member.

The charging system of the present invention is achieved through discharge effect and charge injection effect. Of these, variation of the surface potential in the system due to the change of environment is caused mainly by the influence of charge injection effect. In other words, the charging system of the present invention, is not intended to cause charges to move in both directions through discharge effect, but is to cause charges to be injected through a contact interface from the charging member to the charged member and vice versa. Therefore, it is no more necessary that a peak-peak value of the applied a.c. voltage should be set up two times as much as the discharge starting threshold voltage, unlike Japanese Patent Publication Hei 3 No. 52,058. Accordingly it is possible to reduce cost of the power source for charger, and it is also possible to use an arbitrary a.c. voltage. Here, it should be noted that "the applied a.c. voltage" means "the a.c. voltage applied between the tips of conductive fibers of the charging member and the charged member."

Referring now to FIGS. 4 and 5, description will be made of how the surface potential forming process performed by the charging system of the present invention differs from that performed by the charging system disclosed in Japanese Patent Publication Hei 3 No. 52,058.

Initially, in either case, as the distance between the charging member (for example, a roller or brush) and the charged member (photoconductor) becomes near, discharge will occur between the charging member and the charged member in accordance with the Paschen's law. (This region in which discharge occurs before the contact region is herein referred to as a fore discharge region.) Then the part having passed through the fore discharge region enters the contact region between the charging member and the charged member. By these two regions, a surface potential distribution having jaggedness as shown in FIG. 4 or FIG. 5 is formed on the charged member. In this while, in the case of Japanese Patent Publication Hei 3 No. 52,058, exchange of charges between the charging member and the charged member is made by discharge effect in the fore discharge region, and no charge will exchange in the contact region. In contrast to this, in the charging system of the present invention, the charge injection effect causes charges to exchange between the charging member and the charged member in the contact region.

Thereafter, in a region where the distance between the charging member and the charged member becomes far, there occurs another discharge between the charging member and the charged member in accordance with the Paschen's law. (This region will be referred to as a posterior discharge region.) In the case of Japanese Patent Publication Hei 3 No. 52,058, the amount of charges exchanged through discharge between the charging member and the charged member lowers, so that the jaggedness of the surface potential distribution is offset to form a uniform surface potential distribution. On the contrary, in the charging system of the present invention, the posterior discharge is not enough to eliminate the jaggedness of the surface potential distribution generated by charge injection in the contact region. Hence the jaggedness of the surface potential due to charge injection effect will be left over. If the surface potential of the charged member is observed microscopically, there is observed jaggedness or unevenness as shown in FIG. 5. The interval of the jaggedness formed in the image forming apparatus of the present invention was observed to correspond to Vp/f(mm) where Vp is a processing speed of the apparatus, f is a frequency of a.c. voltage applied.

When an actual image was printed in the present invention using the thus constructed charging system, striped image unevenness perpendicular to the sheet advancing direction was observed on the printed image. The interval of the unevenness was recognized to correspond to a spatial wavelength Vp/f where Vp is a moving velocity of a photoconductor, f is a frequency of a.c. voltage applied. Further, as the peak-peak value of the a.c. voltage was made greater, the striped unevenness appeared more clearly. This fact indicates that, in the previously described charging system of the present invention, the jaggedness of the surface potential which corresponds to the spatial wavelength (Vp/f) on the charged member (where Vp is a processing speed, f is a frequency of the a.c. voltage) could not be erased by the posterior discharge, and the portion with low surface potential was developed to form stripped unevenness.

To solve the problem, the present inventors made experiments and found that the unevenness on the image could be eliminated by establishing a relation as follows:

$$f > Vp/2R$$

where f is a frequency of the a.c. voltage; Vp(mm/s) is a moving velocity of the charged member as a processing speed of the image forming apparatus; and R(mm) is a particle size of a developer used in the image forming apparatus.

This mechanism can be assumed as follows. That is, as explained in the above description of the charging system of the invention, the interval (Vp/f) of the jaggedness of the surface potential formed on the charged member is large when the frequency f of the a.c. voltage is low, therefore, the resolution of the apparatus determined by the particle size of the developer used in the image forming apparatus can follow enough to form striped image unevenness on the image. On the other hand, as the frequency f of the a.c. voltage becomes large, the interval of the jaggedness of the surface potential becomes small. Therefore, a width $\frac{1}{2}\times$ (Vp/f) of the lower-voltage region of the jaggedness of the surface potential on the charged member is smaller than the particle size R(mm) of the developer of the image forming apparatus. As a result, the developer will not adhere to the lower-voltage region, resulting in disappearance of the image unevenness on the image.

Further, in the present invention, ununiformity of the surface potential caused by the application of a.c. voltage at the position of the first charging member is intended to be corrected by the injecting voltage by virtue of the d.c. voltage applied to the second charging member. Of course, if there exists a larger differential voltage between the photoconductor and the second charging member than a discharge-allowable voltage, it is naturally possible to correct the voltage generated by the first charging member.

By reason of the above description, it is necessary to apply a combined voltage of d.c. and a.c. to the first charging member as a main charger, and it is necessary to provide micro-space between the charged member and the first charging member in order to activate discharge. Further, the second charger is to correct the ununiformity generated by the voltage from the first charger with direct current via, at least, charge injection effect. Therefore, it will be easily understood that the d.c. voltage applied to the second charger should be equal to or more than the applied d.c. voltage to the first charging member.

According to the experiment made by the present inventors, this injection effect is a phenomenon that has a certain time constant, and the injected voltage $V_{inj}$ after a time Ti(sec.) passed from the application of voltage naturally increases as the Ti(sec.) becomes great. Here, the time that allows the injection is equal to the time during which the charging member and the charged member contact one another. Therefore, it is preferable that the system is set up so that the photoconductor may contact with the second charging member in a greater duration than with the first charging member.

Judging from the above description only, it is natural to conceive that the case where an a.c. voltage having a peak-peak value of two times or more of the discharge starting threshold voltage is applied to the first charging member could be modified by the second member equivalently arranged and applied with the same d.c. voltage to the case where the a.c. voltage having a peak-peak value of not more than two times the discharge stating threshold voltage is applied.

However, from the experiment, the following facts have been known. That is, if an a.c. voltage having a peak-peak value in excess of two times the discharge starting threshold voltage is applied between the charging member of conductive fabric and a typical organic photoconductor as stated above, the corrective d.c. voltage to be applied to the second charging member must increase as the a.c. peak-peak value becomes large. Further, the surface potential cannot be regulated by the d.c. voltage, but becomes large as the peak-peak value increases so that, in this case, the d.c. voltage cannot control the surface potential. As a result, it is preferable that the peak-peak value of a.c. voltage applied to the first charging member should be set up not more than two times the discharge starting threshold voltage.

Next, consideration will be given on a case where the toner has adhered to the surface of the photoconductor due to a prolonged use of the charging member. Referring to FIGS. 6A and 6B, the charging state of the photoconductor as a charged member will be described as to cases where a diameter of fiber **5*d*** is smaller than the toner size, and vice versa.

Where a diameter of fiber **5*d* is smaller than the particle size of toner 38, if toner 38 adheres to photoconductor 1, toner 38 occupies a space between the tip of fiber 5*d* and the surface of photoconductor 1 as shown in FIG. 6A, to thereby create a portion where the two members cannot contact at all. In this portion, not only will the charge injection effect be inhibited but also the discharge effect in the vicinity of the contact point will be disturbed. As a result, the adhered portion of toner 38** and the periphery thereof to be charged by the fiber cannot be charged, and thereby charging unevenness occurs.

On the other hand, where a diameter of fiber 5*d* is greater than the particle size of toner 38, if toner 38 adheres to photoconductor 1, toner 38 exists as shown in FIG. 6B, but does not entirely disturb the discharge effect in the vicinity of the contact point. In addition, since element 5*d* is made of a fiber as stated above, it is hardly conceivable that fiber 5*d* completely separates from the photoconductor. Accordingly, the part on the photoconductor in the vicinity of the toner is charged through both the charge injection effect and the discharge effect, so that the charging unevenness can be prevented.

Meanwhile, since, as stated above, in the contact charging process, the resistance between the charging member and the charged member lowers as humidity increases, the amount of charges injected to the charged member will increase, raising the surface potential.

In the present invention, varying resistance of the charging member with the humidity is detected, and based on the detection, the voltage value to be applied to the charging member is controlled. Therefore, problem of charge-up will not occur, thus making it possible to stabilize the surface potential of the charged member.

More specifically, the voltage value to be applied to the charging member is controlled by a voltage controlling means comprising a converting means for converting a detected resistance value into a voltage value information signal and a voltage value selecting means for selecting a voltage applied to the charging member from a plurality of preset voltages on the basis of the above voltage value information signal.

DESCRIPTION OF THE PREFERRED EMBODIMENTS

Embodiment of the present invention will hereinafter be described with reference to the accompanying drawings.

Figure 7A:
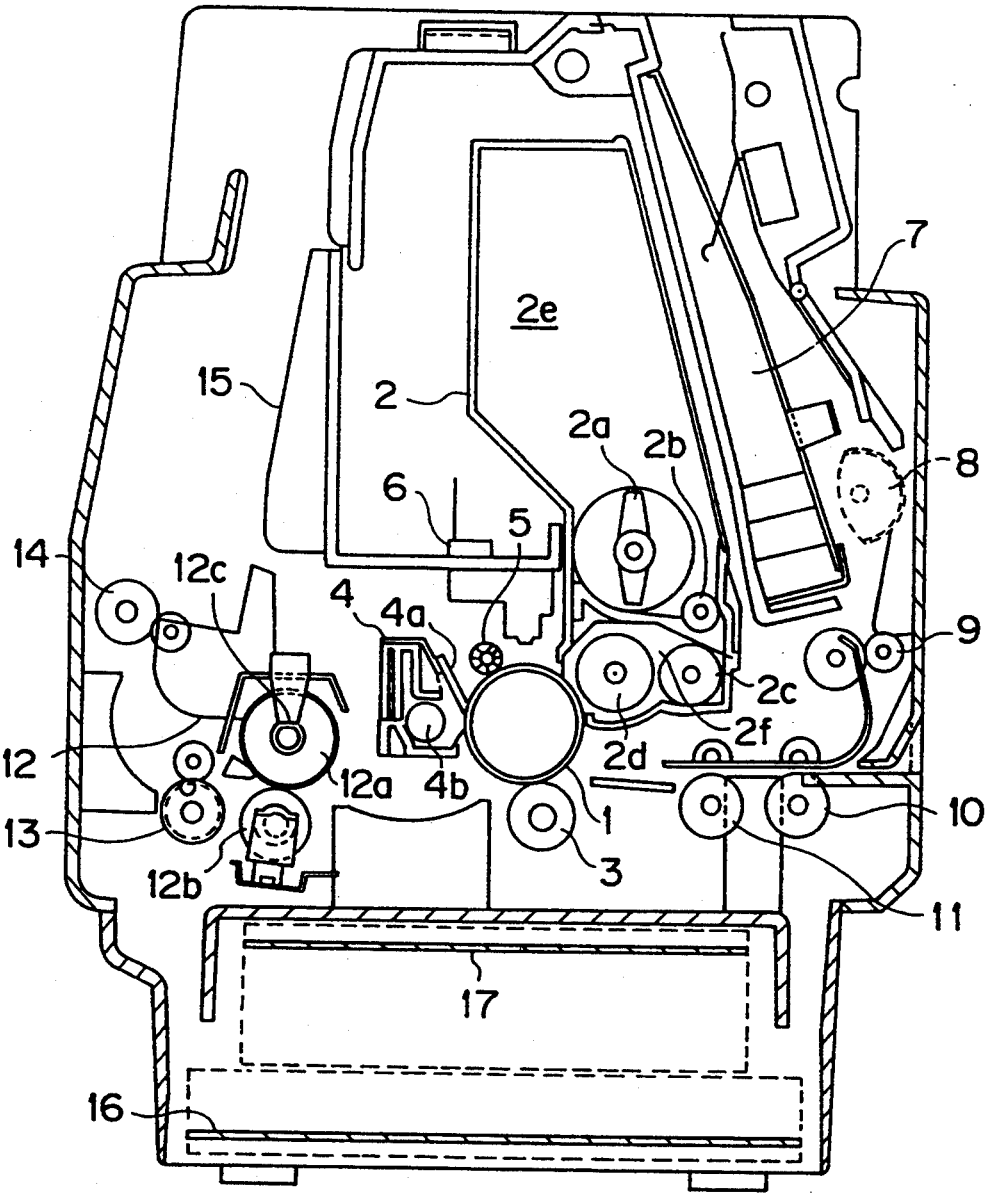
FIG. 7A is a schematic overall illustrative view showing an example of an image forming apparatus to which an electrophotographic charging method of the present invention is applied.
Figure 7B:
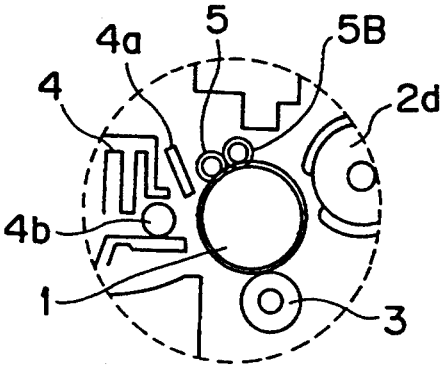
FIG. 7B is a partially illustrative view showing a case where a second charging member is used.

FIGS. 7A and 7B are schematic illustrations showing an overall configuration of the subject image forming apparatus of the present invention. Of these, FIG. 7A is a front view of an embodiment in which a single charging member made of conductive fabric is employed whereas FIG. 7B is a partially shown front view of an embodiment using first and second charging members. Description herein will be made as to a case where conductive fabric used for the charging member is planted in a roller-shape.

Referring to FIG. 7A, reference numeral 16 designates a controller for processing image-generating data transmitted from an unillustrated host computer, and reference numeral 17 designates an engine controller for controlling an activation of the image forming apparatus in response to a signal dictating start of image forming, sent from the controller 16.

Reference numeral 7 indicates a cassette for holding transfer material such as copy sheets. An arrangement is made such that a sheet is drawn out from cassette 7 by a paper feed roller 8 and conveyed by a series of conveyer rollers 9, 10 to a resist roller 11.

A photoconductor drum 1 has a photoconductive layer on a surface thereof, and is rotated at a constant rate by driver means (not shown) in a clockwise direction in FIGS. 7A and 7B. A charger 5 in FIG. 7A or chargers 5 and 5B in FIG. 7B, made mainly of conductive fabric 5A are disposed at a peripheral position of photoconductor drum 1. Around photoconductive drum 1, there are further disposed clockwise from the charger means, an exposure-writing head or exposure unit 6, a developing unit 2, a transfer unit 3 including a transfer roller and a cleaner 4.

Developing unit 2 comprises a toner tank **2*e* having an agitating roller 2*a* therein and a developer hopper 2*f* having a magnet roller 2*d* for electrifying the toner and a mixing roller 2*c* for mixing the toner supplied by a supplying roller 2*b* from toner tank 2*e***.

Cleaner 4 is constructed in the form of a cleaning unit comprising mainly a cleaning blade **4*a* for scraping the toner from the surface of photoconductor drum 1 and a toner conveying screw 4*b*** for conveying the scraped toner to a container (not shown) for collecting the used toner.

Meanwhile, a copy sheet that has passed through a space between transfer unit 3 and photoconductor drum 1 is subjected to a fixing process in a fixing unit 12 which comprises a heat roller **12*a* having a heater 12*c* built therein and a pressure roller 12*b*. Thus fixed copy material is conveyed by a conveying roller 13 and a paper discharging roller 14 to a stack guide 15**.

Next, description will be made on operation of the embodied apparatus of the invention with reference to FIGS. 7A and 7B.

First, data on image generation is sent from an unillustrated host computer to controller 16 to be processed therein. Then a signal that dictates a start of image-forming is sent out to engine controller 17. From then on, the operation proceeds following predetermined steps. A transfer material such as a copy sheet accommodated in transfer material-holding cassette 7 is drawn out one by one by means of paper feed roller 8 to be conveyed through conveyer rollers 9, 10 up to the near side of resist roller 11. Photoconductor drum 1 is driven at a constant rate by the unillustrated rotating mechanism in a clockwise direction in FIGS. 7A and 7B. At the time, in FIG. 7A, charging roller 5 rotates at a constant rate, for example, in an opposite direction to that of photoconductor 1. In FIG. 7B, first charging roller 5 as well as second charging roller 5B rotates at a constant rate in an opposite direction to that of photoconductor 1.

Figure 8A:
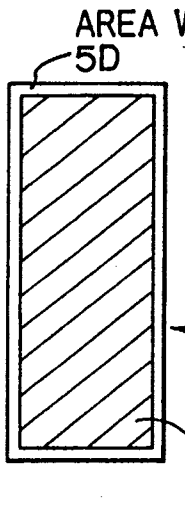
FIG. 8A is an illustration schematically showing a conductive cloth for preparing a charging member used in the present invention.
Figure 8B:
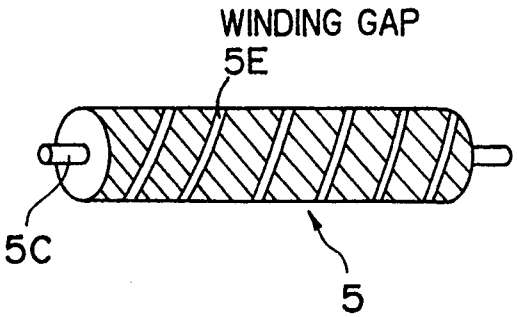
FIG. 8B is an illustration schematically showing a charging member prepared by winding a conductive cloth shown in FIG. 8A.

Charging roller 5 used in FIG. 7A and charging rollers 5 and 5B used in FIG. 7B are formed in the following manner as schematically shown in FIGS. 8A and 8B. A conductive fabric cloth **5*a* is formed with fabric or fiber aggregation made of, for example, rayon planted thereon and with an adjusted amount of carbon particles dispersed thereon so as to obtain a desired resistance. Thus formed conductive fabric cloth 5*a* is swathed on a conductive roller shaft 5*c* of about 6 mm in diameter, to thereby complete a charging roller. Thus formed charging roller 5, or rollers 5 and 5B are coupled with a roller driving motor so as to be rotated. Here, photoconductor 1** used is a conventionally used organic photoconductor (OPC).

In developing unit 2, in order to assure that magnet roller **2*d* may provide toner having a predetermined toner density, toner powder is supplied from toner tank 2*e*, as required, by supplying roller 2*b* to developer hopper 2*f*, and the thus supplied toner powder is agitated by mixer roller 2*c*. During the agitation, the toner is electrified to bear charges of the same polarity with that of the voltage to be charged onto the photoconductor. In this state, when a voltage close to the surface potential of photoconductor 1 is applied to magnet roller 2*d*, the toner powder adheres to a portion that exposure writing head 6** has irradiated, and thus the latent image is visualized.

Next, resist roller 11 sends out a transfer material or copy sheet, etc., by measuring a timing so that the sheet may be positioned corresponding to an image on photoconductor drum 1. The transfer material is nipped between and conveyed by photoconductor drum 1 and transfer roller 3. During this, transfer roller 3 is impressed by a voltage of an opposite polarity to that of the toner. This is why the toner particles on photoconductor drum 1 move onto the transfer material. The toner particles on the transfer material are sandwiched between and conveyed by heat roller **12*a* with heater 12*c* incorporated therein and pressure roller 12*b*. In this while, the toner particles are molten and fixed on the transfer material. Then the transfer material is conveyed by conveying roller 13 and discharging roller 14 to stack guide 15. Meanwhile, toner that has not transferred and remains on the photoconductor drum 1 is scraped from photoconductor drum 1 by cleaning blade 4*a* of cleaner 4 . Thus scraped toner is sent by toner conveying screw 4*b*** to a used toner collecting container (not shown). This is a complete flow of the image forming process.

When a surface potential on the photoconductor is measured without image-forming, a probe for potential-measurement is placed at the position in which the developing hopper locates.

Now, the schematic illustrations in FIGS. 8A and 8B will be again detailed. FIG. 8A shows a bandage with conductive fibers planted thereon. FIG. 8B shows a roller-shaped charging member formed with the bandage of conductive fabric shown in FIG. 8A. Charging member 5 shown in FIG. 8B is constructed by the steps of dispersing an adjusted amount of carbon particles in fabric or fiber aggregation 5A made of, for example, rayon so as to obtain a desired resistance, planting thus prepared fabric or fiber aggregation 5A on a cloth so as to form a conductive fabric **5*a* (FIG. 8A) and swathing conductive fabric cloth 5*a* around a conductive roller shaft 5*c* of about 6 mm in diameter, to thereby complete a charging roller. Thus formed charging roller 5** is coupled with a roller driving motor (not shown) and rotated. The resistance is as much as 100 kΩ, and this value is achieved by planting conductive fabric having a single fiber diameter of 20 μm in a planting density of 80,000 pc./sq.in.

In order to prevent fibers on both sides of conductive fabric 5A from falling out as the charging member being used, a bandage of conductive fabric cloth **5*a*** having some tens millimeters, for example, 20 mm is provided with margins 5D of about 1 mm wide. Thus formed bandage is swathed spirally on conductive shaft 5c made as of metal rod, so as to complete a charging member 5. When the bandage has been wound, margins 5D meet side by side so as to make a gap of 2 mm wide on the cylindrical side of the charging member.

It is possible to wind the bandage with the margins cut off. It may be so, but the fibers might fall out in some cases as the charging member is used, or in the other cases, a winding gap 5E will inevitably occur between the neighbors when the bandage is wound. Therefore, the resulting member will be formed with portions having no conductive fiber planted like a bandage with margins is wound.

Figure 9:
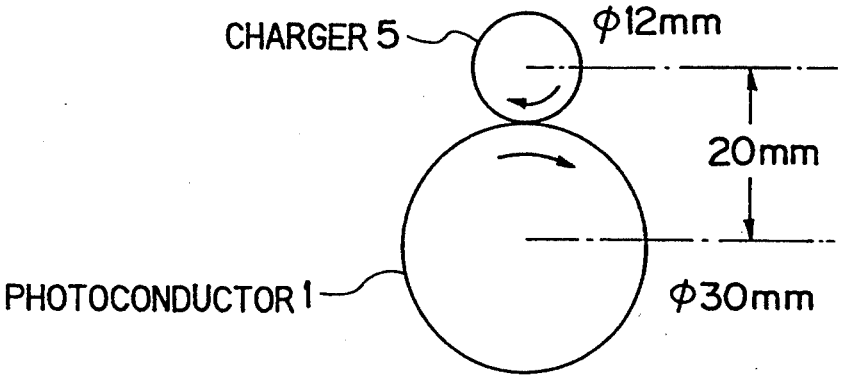
FIG. 9 is an illustration showing an example of dimensional relation between a charging member and a charged member used in an embodiment.

Now, consideration will be given as to rotational velocities of roller 5 and photoconductor 1. If charging roller 5 and photoconductor 1 rotate at an identical peripheral velocity (therefore, at a relative velocity of zero in a contact area), the same surface portions of roller 5 and photoconductors 1 face each other while the two are confronting. As a result, a portion on the photoconductor facing the aforementioned winding gap 5E cannot receive charges, causing charging unevenness. Therefore, when the charging member of conductive fabric 5A is formed into a roller, it is preferable that charging roller 5 and photoconductor 1 should rotate at different peripheral velocity (or the relative velocity should not be zero). As an example shown in FIG. 9, in order to differentiate the peripheral velocities of the two, i.e. photoconductor 1 and charging roller 5, as much as possible, moving peripheral moving directions of the two are made opposite. Here, FIG. 9 is an illustration showing an example of a dimensional relation of photoconductor 1 and charging roller 5.

In the figure, a charged member 1 of 30 mm in diameter, rotating at a linear velocity of 50 mm/sec and a charging member 5 in a form of a roller having a diameter of 12 mm with conductive fabric 5a planted thereon are provided spaced with a center difference of 20 mm. In this case, the contact time in which each part of charged member 1 comes in contact with conductive fabric 5a in one revolution of charged member 1 is 0.13 sec. Therefore, it is understood that an a.c. voltage to be applied to the system should have a frequency of 7 to 8 Hz or more.

Figure 10:
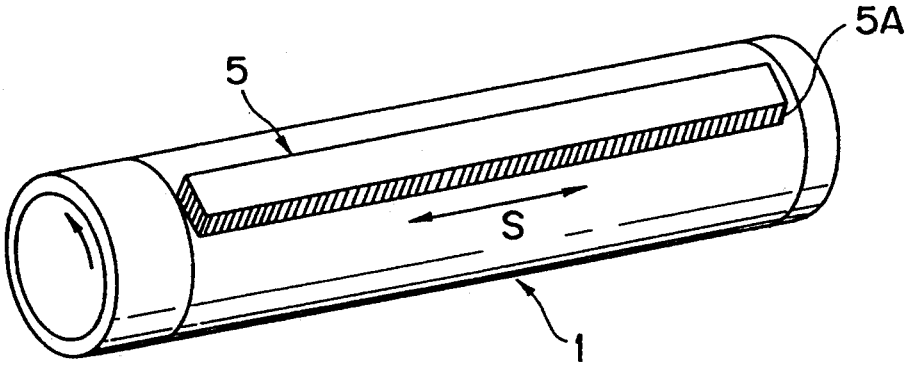
FIG. 10 is a schematic illustrative view showing a use state of a charging member with conductive fibers planted on a flat base thereof.

FIG. 10 is a schematic illustration showing a state where a charging member 5 of a flat structure with conductive fibers 5A planted thereon is used while being brought into contact with a photoconductor 1. As shown in FIG. 10, the charging member 5 vibrates along the surface of photoconductor 1 in directions (as shown by arrow S) perpendicular to the moving direction of photoconductor 1.

In the case where conductive fibers 5A are planted on a flat surface as is shown in FIG. 10, the structure is simple as compared to the roller being rotated, but fibers 5A contact with photoconductor at the same portion, so that fibers 5A may be worn out, or the developer may adhere to the tips of fibers 5A causing the corresponding part of the photoconductor to fail to be charged. Therefore, as shown in FIG. 10, the charging member is preferably vibrated in directions perpendicular to the moving direction of photoconductor 1.

In FIG. 7B, although description was made on the case where both the first and second charging members use roller type chargers, the effect of the present invention should not be limited to this example, and the effect of the present invention can be, of course, realized using a plurality of brush type chargers, or a combination of roller type and brush type chargers.

Next, the present invention provides a technique to solve the problems relating to the voltage stability of charging member 5 using a conductive fabric or an aggregation of conductive fibers. As is also apparent from the previous description related to FIGS. 3A and 3B, the present invention is intended to achieve the stability of surface potential by applying a combined voltage of a.c. and d.c. voltages between a charging member 5 and charged member 1 so that the a.c. voltage may actively promote charges to move between the two members through the contact area (that is, not only move from charging member 5 to charged member 1 but also move from the latter to the former) while the d.c. voltage regulates the amount of charges on charged member 1.

In this charging method in which charging member 5 and charged member 1 face one another sharing a contact point B and micro-clearance c therebetween, the charging is effected through at least discharge effect and charge injection effect by applying a combined voltage of d.c. and a.c. voltages between charging member and charged member 1. In the method of the present invention, the absolute value of a difference between a surface potential and a combined voltage when the absolute value of the combined voltage of d.c. and a.c. voltages applied between charging member 5 and charged member 1 takes a minimum value, is set up to be less than the absolute value of a discharge starting threshold voltage that is determined by the surrounding atmosphere.

This limitation substantially corresponds to an application of the combined voltage between charging member 5 and charged member 1 consisting of a d.c. voltage and an oscillating voltage having a peak-peak value of less than two times the discharge starting threshold voltage. Besides, in the present invention, the moving velocity of the surface of the charging member 5 relative to that of the charged member 1 is set up so as not to be zero. With the thus specified limitations, the present invention prevents the variation of surface potential and the charging defect (charging ununiformity) from occurring.

As has been described, the charging method of the present invention is carried out through discharge effect and charge injection effect. Of these, the charge injection effect is assumed to dominate the variation of surface potential occurring with the change of environment. In other words, in the present invention, the limitation "the absolute value of a difference between a surface potential of charged member and an applied voltage when the absolute value of the applied combined voltage takes a minimum value, is set up to be less than the absolute value of a discharge starting threshold voltage" is not intended to cause charges to move in both directions through discharge effect, but is to cause charges to be injected through a contact point B from charging member 5 to charged member 1 and vice versa. In almost all cases, the limitation agrees, as previously described, with a limitation "an a.c. voltage having a relatively small amplitude, specifically, a peak-peak value of not more than two times the discharge starting threshold voltage is superposed."Here, it should be noted that "the applied a.c. voltage" means "the a.c. voltage applied between the tip of conductive fiber 5a of the charging member and charged member 1."

Now, the effect of the present invention will be detailed quantitatively referring to an embodiment.

Here, assume that a charged member used has a dielectric constant $\epsilon p$, and a film thickness Dp and the gap is filled with air, the discharge starting threshold voltage can be calculated as follows on the basis of the Paschen's relation between discharge characteristics and voltage applied to gap:

discharge starting threshold voltage (Vth)

$$=(7737.6Dp/\epsilon p)^{\frac{1}{2}}+(312+6.2Dp)/\epsilon p$$

In a typical organic charged member, $\epsilon p=3$, $Dp=20$ μm (micrometers). Accordingly the discharge starting threshold voltage (Vth) is determined 580 V from the above formula. A desirable surface potential for organic charged member generally falls within a range of from about −550 V to −650 V.

Figure 11:
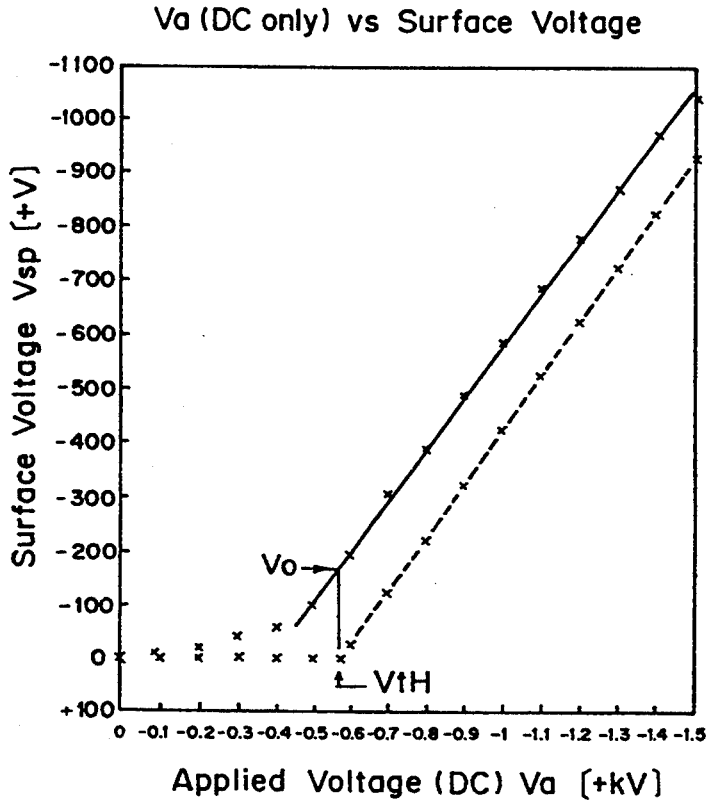
FIG. 11 is an experimental plot, typically showing a relation between applied d.c. voltages and surface potentials in a normal temperature, normal humidity environment, obtained when a charged member made of conductive fabric and a typical organic charged member are used.

First, description will be made of a case where a −950 V d.c. voltage is applied to conductive fabric 5a of charging member 5. In this case, as has been described with reference to FIGS. 3A and 3B, the potential of an arbitrary point A on charged member 1 is raised up at −370 (=−|950 V−580 V|) through discharge effect. Then, at a contact point B, conductive fiber 5a has a differential potential of −580 V relative to charged member 1, and this voltage difference causes one-way injection of charges from charging member 5 into charged member 1. Accordingly, the absolute value of the surface potential of charged member 1 rises so as to reduce the potential difference between the two. FIG. 11 is an experimental plot, showing a relation between applied d.c. voltages and surface potentials in a normal temperature, normal humidity environment, obtained when a charging member made of conductive fabric 5a and a typical organic charged member are used. From this plot, the following fact 1), 2) and 3) are found.

1) A rise of surface potential (Vsp) is observed in a range of less than the discharge starting threshold voltage (Vth) previously calculated.

2) Surface potential (Vsp) increases linearly over the discharge starting threshold voltage (Vth) and the linear relation can be expressed by Vsp=Vap−Vth+160 (V).

3) The value 160 (V) corresponds to a surface potential (Vsp) when applied voltage (Vap) is equal to discharge starting threshold voltage (Vth).

From these facts, as to a charging process using a charging member 5 made of a conductive fabric 5c, it is understood that surface potential (Vsp) is generated by charge injection (charge movement) through contact point B) during the applied voltage (Vap) is below Vth, whereas surface potential (Vsp) after discharge starts is composed of a sum of a voltage generated by discharge and the voltage (160 V) generated by charge injection effect.

The voltage (160 V) generated by charge injection effect varies in accordance with the change of environment, the passage of time, etc., to thereby lead a variation of the surface potential. More clearly, if the charging system is placed in a high temperature, high humidity environment, the contact area absorbs moisture, and therefore the contact resistance lowers markedly. The lowering of the contact resistance promotes charges to move into charged member 1 to thereby raise the surface potential (Vsp). Alternatively, the state at contact point B varies with the passage of time, and this changes the magnitude of the voltage to be generated by charge injection effect, therefore bringing about a variation of surface potential (Vsp).

Figure 1:
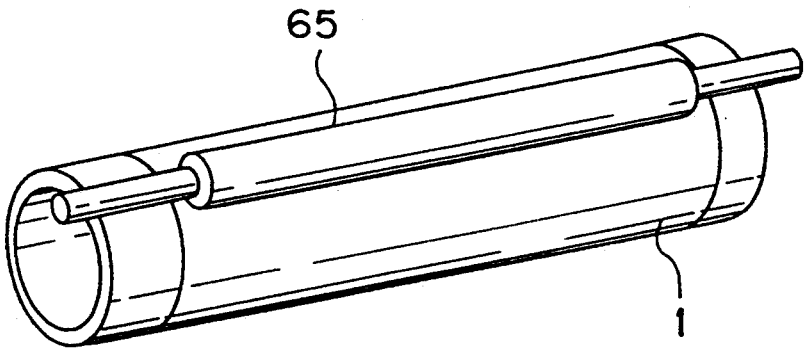
FIG. 1 PRIOR ART
FIG. 1 is a perspective view of an example of a prior art electrophotographic charging system.
Figure 2:
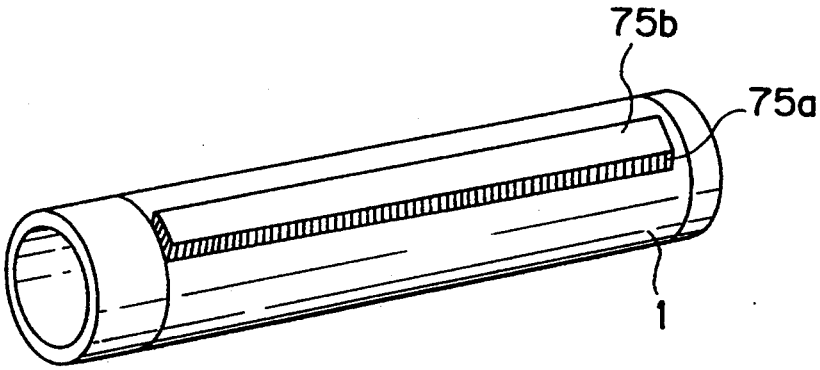
FIG. 2 PRIOR ART
FIG. 2 is a perspective view of another example of a prior art electrophotographic charging system.
Figure 3A:
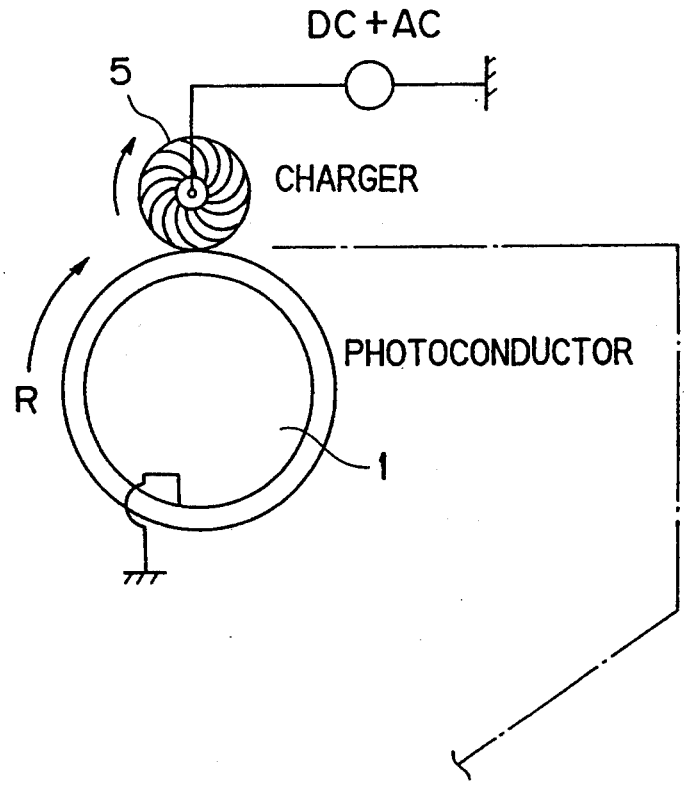
FIG. 3A is a schematic overall diagram showing a principle of charging where a d.c./a.c.combined voltage is applied to a conductive fabric.
Figure 3B:
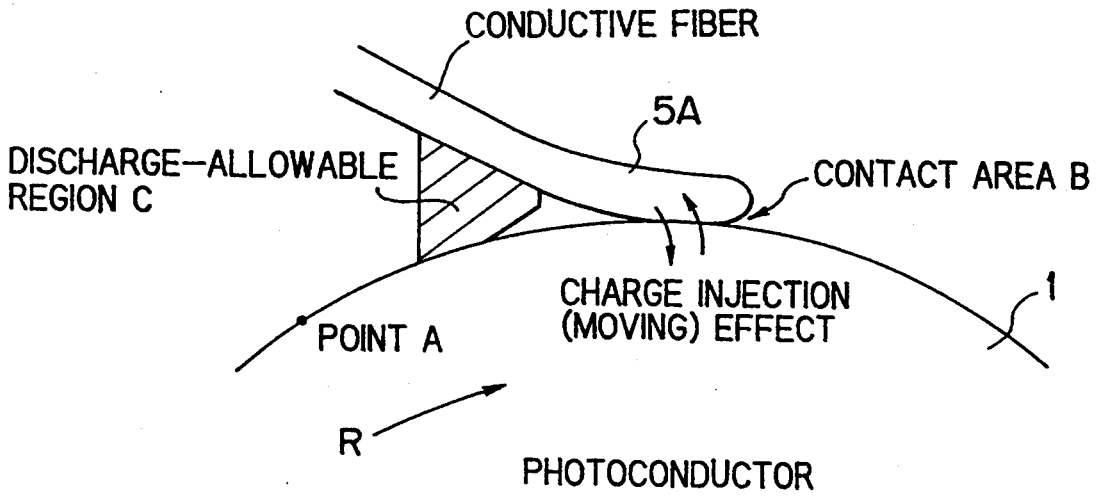
FIG. 3B is an enlarged view of FIG. 3A partially showing the vicinity of a contact area.
Figure 4:
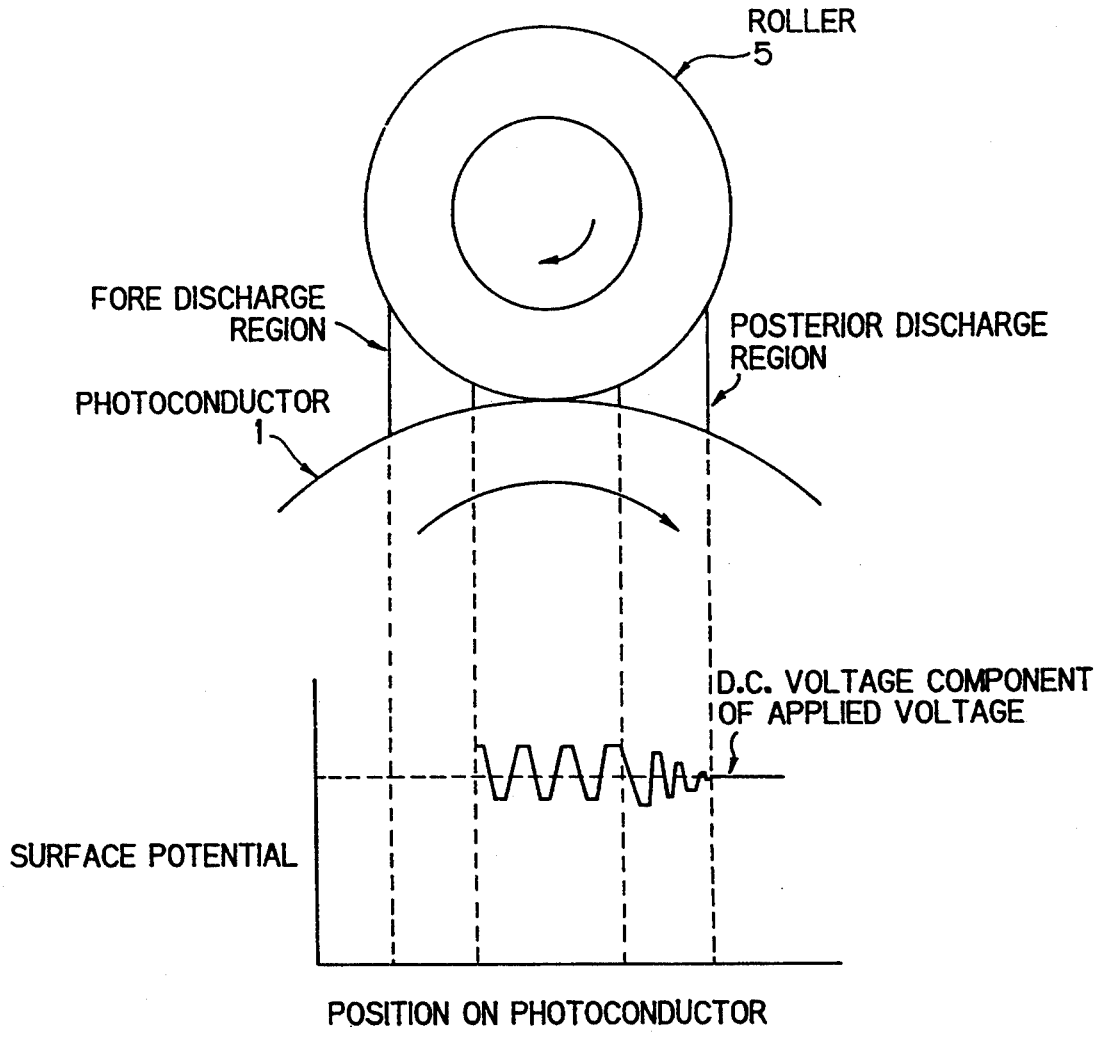
FIG. 4 is a schematic diagram showing an example of a forming process of a surface potential described in the prior art.
Figure 5:
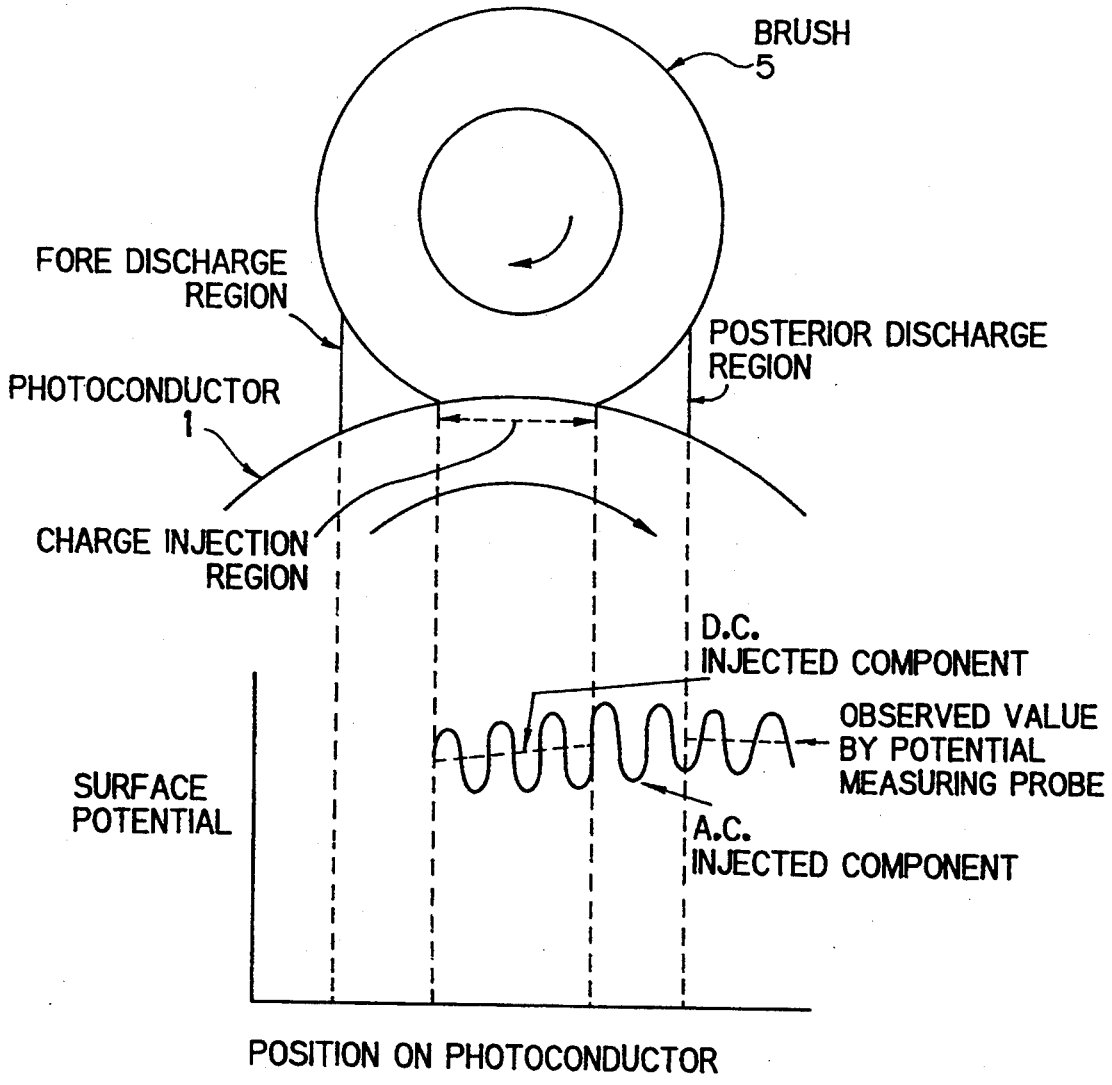
FIG. 5 is a schematic diagram showing a principle of a surface potential forming process in the present invention.
Figure 6A:
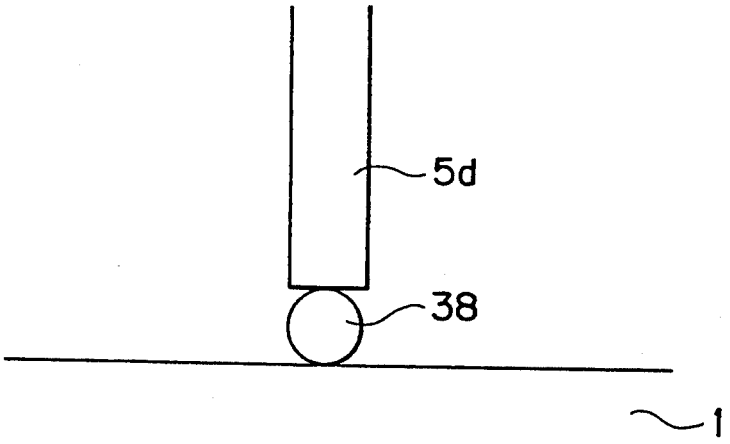
FIG. 6A is a schematic diagram showing an example of a principle of charging in the present invention, where toner size is greater than a diameter of a fiber.
Figure 6B:
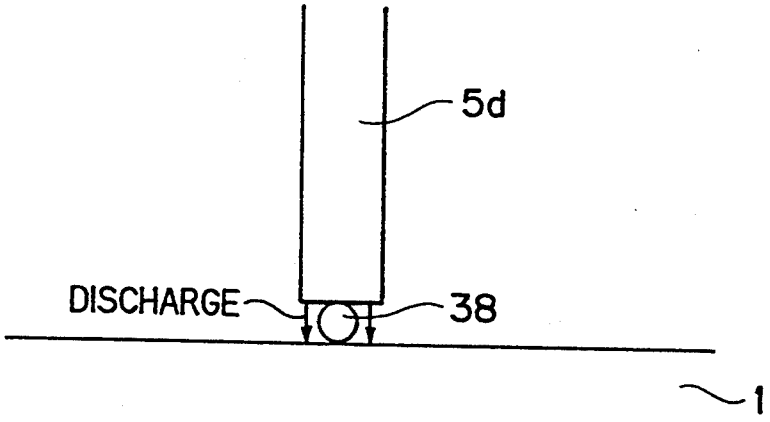
FIG. 6B is a schematic diagram showing an example of a principle of charging in the present invention, where a diameter of a fiber is greater than toner size.

Next, consideration will be given as to a case where a combined voltage (a.c. voltage and d.c. voltage) is applied to charging member 5. Assume that the d.c. component of the applied combined voltage is −550 V and the a.c. component has a peak-peak value of 800 V (±400V). By this setup, the lowest voltage of the combined voltage is −950 V, and an arbitrary point A on the discharged member, as shown in FIGS. 3A and 3B, is charged up to −370 V (−|950−580|=−370 V) via discharge effect. Then, the part of charged member 1 comes out from the region in which discharge is allowed (having a surface potential of −370 V when leaves the region) and reaches contact point B. At point B, conductive fabric 5a is surely applied with a varying voltage of from −150 to −950 V. Accordingly, the potential difference between point A and conductive fabric 5a is apparently as low as less than the discharge starting threshold voltage. Therefore, no discharge will occur in the clearance c in the vicinity of the microspace around the contact point. More explicitly, when the combined voltage takes a minimum absolute value, i.e., the combined voltage is −150 V, the potential difference relative to the surface potential is 220 V, which cannot cause charges to move from charged member 1 to charging member 5 via discharge effect.

Deviation of the potential of the charging member from the potential of the charged member (i.e., 370 V) varies asymmetrically from −580 V to +220 V. Accordingly, exchange of charges (movement in two-way) is induced at contact point B so that the deviation of the potential of the charging member may become symmetrical, i.e., ±400 V. In addition, the a.c. voltage component causes the impedance at contact point B to lower, thus promoting the movement of charges. By such mechanism, surface potential (Vsp) becomes close to and converge to the applied d.c. voltage (here, −550 V,) or thereabout.

It is obvious from the above description that a final surface potential (Vsp) will not vary, and takes a stable property even if the environment changes as long as the exchange of charges (two-way movement of charges) is allowed.

Inasmuch as only the description above is considered, it is natural to conceive that Japanese Patent Publication Hei 3 No. 52,058 in which a specific a.c. voltage having a peak-peak value of two times or more of the discharge starting threshold voltage is applied, should and could produce the same effect. However, as having carried out experiments intensively, the present inventors found the following facts.

That is, when an a.c. voltage in excess of two times the discharge starting threshold voltage is applied to a system comprised of a charging member made of a conductive fabric and a typical organic charged member, in the prior art, 1) the surface potential cannot be regulated by the d.c. voltage, but becomes large following the peak-peak value.

In contrast with this, in the present invention, 2) the surface potential can be adjusted in agreement with the applied d.c. voltage by setting up a peak-peak value as to be a certain value less than two times the discharge starting threshold voltage.

Besides, when an image evaluation test was performed in a marketed printer with the charging system incorporated, in the prior art, 3) there appeared stripes extending perpendicular to a sheet proceeding direction. That is, the uniformity of the surface potential could not be achieved.

In contrast to this, in the present invention, 4) the occurrence of the stripes could be diminished by setting up a peak-peak value as to be less than two times the discharge starting threshold voltage.

Thus, as clear from the above description, the effects of the present invention wherein a charging member made of a conductive fabric is used can be exhibited only by setting up an applied a.c. voltage as to be a certain value less than two times the discharge starting threshold voltage. That is, the content of the present invention is quite different from the technical content disclosed in Japanese Patent Publication Hei 3 No. 52,058 wherein a roller or pad made of a resin is used as a charging member.

With regard to the frequency of the oscillating electric field, any point A on the charged member must receive one period of oscillating field through the contact area in which charges are exchanged. Otherwise point A could not receive a symmetrical potential variation in both positive and negative directions. As a result, the surface potential would be overlaid with the periodically varying oscillating voltage, and could not converge to the d.c. voltage, as apparent from the above description.

Referring now to FIGS. 3A and 3B, a charging process will be considered where a roller-shaped charging member 5 made with conductive fabric 5*a* and a charged member 1 both rotate in a direction of arrow R. As previously described, a tip of conductive fiber 5*a* approaches the surface of charged member 1 as charging member 5 and charged member 1 rotate. When a voltage in excess of a discharge starting threshold voltage (Vth) calculated by the Paschen's discharge law is applied across a clearance c between the tip of conductive fiber 5 and the surface of charged member 1, discharge is activated and an arbitrary point A on charged member 1 receives and holds charges, thus, the charged member 1 is electrified. The surface potential (Vsp) of charged member 1 will continue to rise until the voltage across the clearance becomes equal to the discharge starting threshold voltage (Vth). Then, the discharge stops. That is, if the dark attenuation of the potential charged on the charged member could be neglected, the relation Vsp=Vap (applied voltage to conductive fiber)−(Vth) holds.

Then, point A maintaining the surface potential (Vsp) applied, comes out from the discharge-allowable region, and moves to a contact area B in which the charged member is in contact with conductive fabric 5*c*. When point A reaches contact area B, the potential difference between the tip of conductive fiber 5*a* and contacting point A on charged member 1 is naturally equal to Vth. This potential difference promotes charges to move or be injected from conductive fiber 5*a* onto charged member 1, thus increasing the surface potential (Vsp). In sum, it should be understood that the surface potential (Vsp) is generated through discharge effect and charge moving (injection) effect.

In this discharge effect, a voltage (Vg) to be applied across the clearance c can be expressed as follows:

$$Vg = Vap \times Dair(Dp/kp + Dair),$$

where Dair: distance of clearance, Dp: film thickness of charged member, kp: dielectric constant.

As previously described, when the voltage (Vg) is higher than the discharge starting threshold voltage (Vth), discharge will be allowed. Therefore, it is easily understood that a region in which discharge is allowed for a certain applied voltage (Vap) is limited to a region determined by a certain distance of clearance (Dair). On the other hand, the charging injection effect, of course, occurs in a region in which charging member 5 and charged member 1 may contact each other. As a result, it is apparent that a point A on charged member 1 is charged within a very limited area.

Turning back to the problem of the charging ununiformity to be solved by the present invention, an ideal case will be considered. Assume that a sufficient voltage as compared to the discharge starting threshold voltage (Vth) is applied to a roller-shaped charging member having conductive fabric compactly or densely planted thereon without leaving any space. In such a case, a point A on the surface of charged member 1 would necessarily face conductive fabric 5*a* in a clearance c in which the applied voltage is allowed to be over the discharge starting threshold voltage (Vth), and thereafter could contact with the tip of conductive fibers 5*c* at contact point B. As a result, all the area on charged member 1 would be charged uniformly.

Figure 12A:
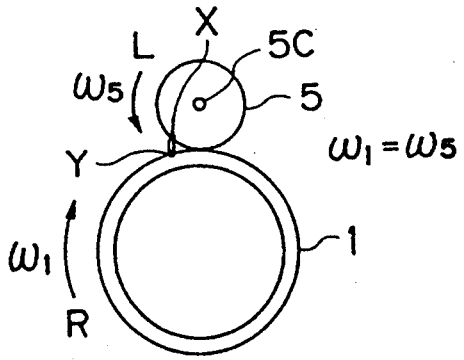
FIG. 12A is a schematic illustration showing a case where a charging member and a charged member rotate at the same peripheral velocity in opposite rotational directions.
Figure 12B:
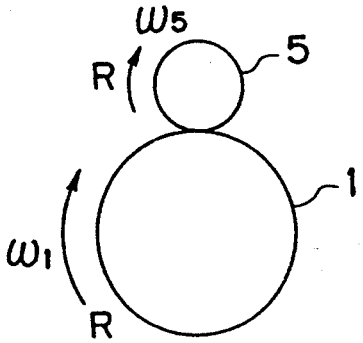
FIG. 12B is a schematic illustration showing a case where a charging member and a charged member rotate in the same rotational direction.
Figure 12C:
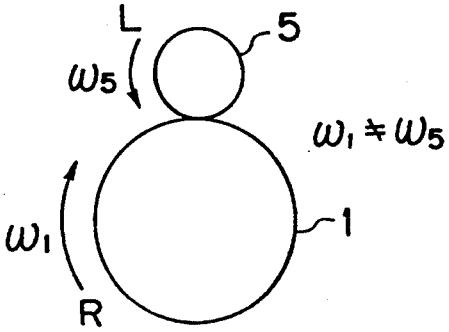
FIG. 12C is a schematic illustration showing a case where a charging member and a charged member rotate at different peripheral velocities in opposite rotational directions.

FIGS. 12A, 12B and 12C are diagrams for illustrating states of rotations of the charging member and the charged member. In the figures, R and L indicate clockwise and counterclockwise rotations, respectively.

A real, roller-shaped charging member 5 inevitably has portions in which no conductive fabric 5*a* is planted as previously stated.

When, as shown in FIG. 12A, charging member 5 and charged member 1 rotate at the same peripheral velocity($\bar{\omega}_1 = \bar{\omega}_5$) with the surfaces of the two moving in the same direction at the contact, a point Y on charged member 1 is constantly opposed to the same point in passing through the discharge allowable region. Therefore, the points on charged member 1 to be opposed to an area X with no fabric plated on charging member 5 lose an opportunity to receive charges.

This is conceived as the cause of charging defect and charging unevenness that would arise when use is made of a charging member 5 prepared by winding a conductive fabric 5*a* in a roller-shape.

To avoid this, the peripheral velocities ($\bar{\omega}_1$ and $\omega_5$) for charging member 5 and charged member 1 are selected to be different each other, so that the relative peripheral velocity between the two will not be zero. This setup enables all the points on charged member 1 to necessarily face conductive fibers 5*a* on charging member, and thus the charged member can be charged uniformly.

Here, the situations in which the relative peripheral velocity between the two will not be zero include the following two cases.

(a) The two members rotate in the same rotational direction (with the surfaces of the two moving in opposite directions at the contact), as shown in FIG. 12B. In this case, the peripheral velocity for each does not matter.

(b) The two members rotate in opposite rotational directions (with the surfaces of the two moving in the same direction at the contact) with different peripheral velocities ($\bar{\omega}_1 \neq \bar{\omega}_5$).

Next, the test result of the charging method of the present invention will be described in comparison with that of the prior art charging method.

Dependence upon variation of environment

Result 1 (prior art example)

A cloth on which conductive fibers ("REC", a product of UNITIKA, prepared by dispersing conductive carbon particles into rayon fibers) had been planted was wound on a metal shaft with a conductive bond to form a roller-shaped charging member 5. The thus formed roller-shaped charging member was placed as shown in FIGS. 3A or 9 such that tips of fibers could be in contact with a charged member 1. In this system, the charged member was charged by applying a voltage through the charging member. The charging experiment was performed in a normal temperature, normal humidity environment (25° C., 55%) and in a high temperature, high humidity environment (35° C., 85%). The result is shown below.

Here, the applied voltage to charging member 5 was −1.05 kV d.c.

TABLE 1

| Environment | Surface potential (V) |
|---|---|
| Normal temperature, normal humidity environment (25° C., 55%) | −611 V |
| High temperature, high humidity environment (35° C., 85%) | −692 V |

As apparent from the above result, when charging was effected using a d.c. voltage in accordance with the conventional method, the surface potential rose as much as 81 (V) with the change of environment, so that this method was found to be impractical at this stage. Actually, image testing was performed in a marketed printer with this conventional charging method. From this image testing, a change in image density was observed with the variation of environment as expected.

Dependence upon time

Result 2 (prior art example)

On the same condition as described in the conventional method above (only d.c. voltage applied), the time-dependent variation of the surface potential was investigated using a virgin charging member 5. The result is shown below.

TABLE 2

| Time (min.) | Start | 1 | 2 | 3 | 4 | 5 | 6 | 7 | 8 | 9 |
|---|---|---|---|---|---|---|---|---|---|---|
| Surface potential (−V) | 644 | 630 | 624 | 619 | 615 | 612 | 608 | 608 | 603 | 596 |

As apparent from the above, the surface potential lowered gradually with the passage of time, and it was found that the potential was not stable after 10 minutes.

Result 1 (example 1 of the present invention)

The same charging member 5 as described in the above prior art was used in the same mechanical condition except in that applied voltage used was a combined voltage of d.c. voltage of −650 V and a.c. voltage (100 Hz) having a (peak-peak) potential difference of 950 V (which was not more than two times of the discharge starting threshold voltage). The same evaluation was carried out. The result is shown in Table 3 below.

TABLE 3

| Environment | Surface potential (V) |
|---|---|
| Normal temperature, normal humidity environment (25° C., 55%) | −620 V |
| High temperature, high humidity environment (35° C., 85%) | −638 V |

As in this case, when an a.c. voltage having a peak-peak of not more than two times of the discharge starting threshold voltage was superposed, voltage variation due to the change of environment could be regulated within a substantially practical range. Actual image testing was performed in a sold printer with this method, and no significant change in image density was observed with the variation of environment.

Result 2 (example 2 of the present invention)

The same experiment as in example 1 was carried out in the same condition except in that applied voltage used was a combined voltage of d.c. voltage of −650 V and a.c. voltage (10 Hz) having a (peak-peak) potential difference of 950 V. Voltage variation in dependence upon the change of environment was investigated as in example 1 of the present invention. The result is shown in Table 4 below.

TABLE 4

| Environment | Surface potential (V) |
|---|---|
| Normal temperature, normal humidity environment (25° C., 55%) | −615 V |
| High temperature, high humidity environment (35° C., 85%) | −640 V |

As shown in Table 4, equivalent result to the result of example 1 was obtained, but ripples in surface potential were observed along the moving direction of the charged member.

Therefore, an actual image was printed in a marketed printer. The printed image was found to have striped unevenness appearing at intervals corresponding to a distance calculated from the peripheral velocity of charged member 1 and the a.c. frequency. From this result, it was confirmed evidently that at least one period of oscillation of the superposed a.c. voltage should be applied during a part of the charged member is being in contact with the charged member.

Result of the present invention

Variation in the surface potential with time was evaluated using a virgin charging member on the condition stated in the above example 1 of the present invention. The result is shown in Table 5 below.

TABLE 5

| Time (min.) | Start | 1 | 2 | 3 | 4 | 5 | 6 | 7 | 8 | 9 |
|---|---|---|---|---|---|---|---|---|---|---|
| Surface potential | 620 | 618 | 616 | 620 | 615 | 615 | 619 | 615 | 620 | 620 |

TABLE 5-continued

| Time (min.) | Start | 1 | 2 | 3 | 4 | 5 | 6 | 7 | 8 | 9 |
|---|---|---|---|---|---|---|---|---|---|---|
| (−V) | | | | | | | | | | |

As observed in the above table, the surface potential was stable, and it is explicit that the effect disclosed by the present invention is exhibited.

In order to study the relation between the rotational velocities of the charged member 1 and the roller-shaped charging member 5 with conductive fibers 5*a* planted thereon, the following experiment was performed.

Prior art example

A cloth of ten-odd millimeters wide on which conductive fibers ("REC", a product of UNITIKA, prepared by dispersing conductive carbon particles into rayon fibers) had been planted was swathed spirally on a metal shaft 5*c* to form a charging member 5. FIG. 7A shows a mechanical relationship of thus formed charging member 5 and a charged member. The two members were rotated with the surfaces of the two moving in the same direction at the contact with the same peripheral velocity of 52 mm/sec. As the charging member was applied with d.c. voltage of −1.05 kV, image performance and characteristics of surface potential were evaluated using a marketed laser printer.

Image performance

Figure 13:
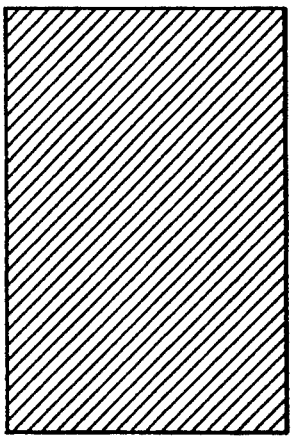
FIG. 13 is a schematic view for illustrating image unevenness caused by a winding gap formed in winding a conductive fabric cloth around a charging member.

Observed was image unevenness, as shown in FIG. 13, of stripes ranging obliquely with respect to the sheet advancing direction in the printer. A distance between the stripes was measured. As a result, the distance agreed with the interval between the winding gaps where no conductive fiber was planted on the roller-shaped charging member. Therefore, the causality between the two were confirmed.

Surface potential Characteristics

Comparison of surface potential was made between in a normal temperature, normal humidity environment (25° C., 50 to 60 %RH) and in a high temperature, high humidity environment (35° C., 80%RH). As a result, the surface potential in the latter environment was observed to be 80 to 90 V higher than that in the former. Accordingly, the surface potential in this system was found to be unstable against the change of environment.

Example of the present invention

Image performance

In an environment of normal temperature and normal humidity (25° C., 50 to 60 %RH), image performances were investigated in the same way except in that the rotational direction of the roller-shaped charging member or the peripheral velocity of rotation was changed. The result is shown in tables below.

TABLE 6a

In a case where the surfaces of the two members move in the same direction at the contact

| Peripheral velocity of charger (mm/sec.) | 12.5 | 25 | 52 | 150 |
|---|---|---|---|---|
| Image performance | Medium | Medium | Bad | Excellent |

TABLE 6b

In a case where the surfaces of the two members move in opposite directions at the contact

| Peripheral velocity of charger (mm/sec.) | 12.5 | 25 | 52 | 150 |
|---|---|---|---|---|
| Image performance | Excellent | Excellent | Excellent | Excellent |

Here, "Excellent" indicates 'no image unevenness is found'; "Medium" indicates 'image unevenness appears if the surface potential lowers'; and "Bad" indicates 'image unevenness appears always."

As is apparent from the testing result, the effect of eliminating image unevenness was exhibited except when the roller-shaped charging member 5 and the charged member 1 were rotated with the surfaces of the two moving in the same direction at the contact at the same peripheral velocity of rotation. Especially, the effect was excellent when the surfaces of the two members move in opposite directions at the contact.

In the connection of this experiment, it was found that selection of the directions of rotations and the peripheral velocities of rotation could have no effect on the regulation of variation of the surface potential occurring with the change of environment.

Surface potential Characteristics

The roller-shaped charging member and the charged member were rotated so that the surfaces of the two members move in opposite directions at the contact with the same peripheral velocity of 52 mm/sec. The charging member was applied with a combined voltage of d.c. voltage of −500 V and a.c. voltage (100 Hz) having a peak-peak value of 1000 V (The charged member used here has a film thickness of 20 μm and a dielectric constant of 3.13, so that the discharge starting threshold voltage is calculated to be 574 V. Therefore, it is understood that the peak-peak value is not more than two times of the discharge starting threshold voltage.) Surface potential characteristics were investigated in the same way described in the prior art example. As a result, voltage variation from a normal temperature, normal humidity environment (25° C., 50 to 60%RH) to a high temperature, high humidity environment (35° C., 85%RH) could be inhibited within 5V.

From this result, it could be reconfirmed that the surface potential will be stabilized when a combined voltage comprised of a d.c. voltage in correspondence with a desired surface potential and an a.c. voltage having a peak-peak value of not more than two times of the discharge starting threshold voltage is selected as a voltage applied to the charging member.

Selection of frequency

Figure 14:
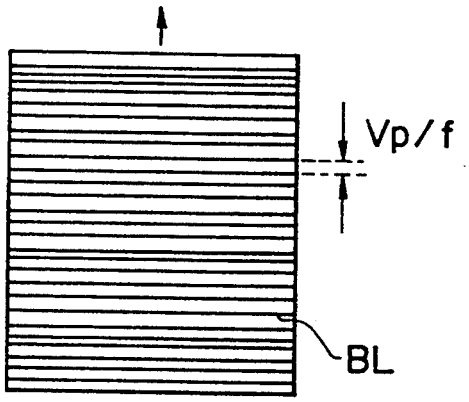
FIG. 14 is a schematic view for illustrating a state of occurrence of image unevenness where a discharge starting threshold voltage and peak-peak value have a conventional relation.

On the same condition as described in the above section (surface potential characteristic) except in that the frequency of the a.c. voltage is changed to 10 Hz, dependence of the surface potential (Vsp) upon environment was investigated. As a result, it was found that the a.c. voltage of 10 Hz exhibited the same effect as the a.c. voltage of 100 Hz did. Nevertheless, as image performance was tested on this condition, there appeared image unevenness, as shown in FIG. 14, of black lines (shown by BL) extending in a direction perpendicular to the sheet advancing direction. From the interval of the lines, a frequency was calculated, which agreed with the frequency of the applied a.c. voltage (10 Hz). This result evidenced that the a.c. voltage was overlaid onto the surface potential. The distance (Vp/f) between the lines is an interval of the jaggedness of the surface potential, which will be described hereinafter.

This experimental result is to support the justification of the theory which describes that the contact time in which each part of the charged member comes in contact with the charging member during the charged member rotates in one revolution should be at least one period of the a.c. voltage applied.

Next, as another example of the present invention, image evaluation and measurement of surface potential were carried out in an image forming apparatus shown in FIG. 7A wherein a moving velocity Vp of a photoconductor 1 as a charged member was set at 52.4 mm/sec., and a developer having a particle size R of 15 μm was provided in developing unit 2. The experiment was performed for each of the following conditions, that is, by changing the condition of the voltage applied to charging roller 5 as a charging member.

1)d.c. voltage VDc=−650; a.c. voltage Vp-p=900 V;

frequency=100 Hz; and condition on frequency: f<Vp/2R.

2)d.c. voltage VDc=−550; a.c. voltage Vp-p=1500 V;

frequency=100 Hz; and condition on frequency: f<Vp/2R.

3)d.c. voltage VDc=−650; a.c. voltage Vp-p=900 V;

frequency=2000 Hz; and condition on frequency: f>Vp/2R.

4)d.c. voltage VDc=−550; a.c. voltage Vp-p=1500 V;

frequency=2000 Hz; and condition on frequency: f>Vp/2R.

5)Only d.c. voltage is applied, VDc=−1050 V.

(a)Result of measurement on surface potential Measurement of the surface potential was made for the above conditions 1) to 4). The result showed that variation of surface potential with the passage of time could practically be eliminated as compared to the measurement for condition 5) in which only a d.c. voltage was applied. Specifically, all the surface potentials in conditions 1) through 4) were observed to be uniformly generated at about −550 V. Further, variation of surface potential due to the change of environment was significantly reduced as compared to the measurement in which only a d.c. voltage was applied.

Here, although the above description expresses "the surface potential was observed to be uniformly generated", this must be attributed to the low resolution of the measuring apparatus. More specifically, the probe used for measuring the surface potential has a spatial resolution of 3 mm, whereas the jaggedness of the surface potential on the photoconductor has a spatial wavelength of 52.4/100=0.52 mm. Therefore, the resolution of the probe was too large to pick up the jaggedness of the surface potential, so that the measured output was given in a form of the average of the jaggedness of the surface potential. This is because the surface potential was observed to be uniform on the face of it.

Figure 15:
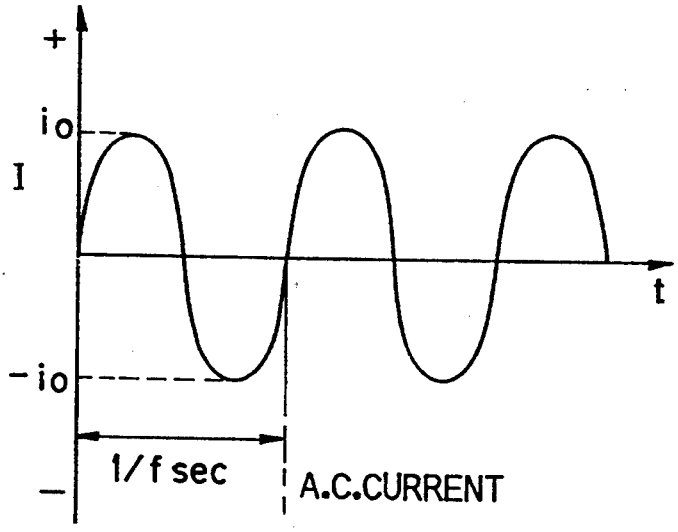
FIG. 15 is a sinusoidal curve showing an example of a current waveform obtained when a surface potential of a charged member is measured.
Figure 16:
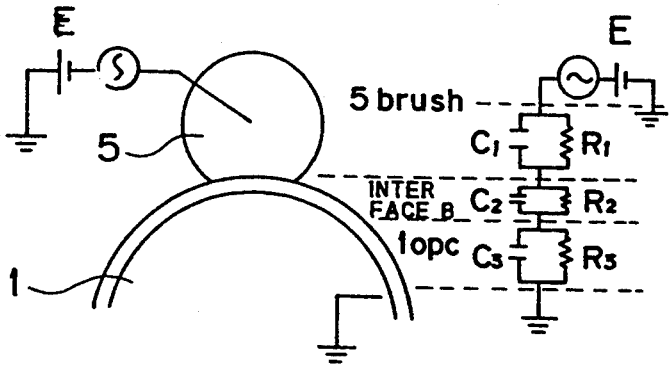
FIG. 16 is a diagram showing an equivalent circuit of a series of a charging member (roller or brush), a contact interface and a charged member (photoconductor)

To deal with this, a current flowing into the photoconductive drum was measured while the surface potential was measured. The current observed at the time showed a sinusoidal wave form symmetrical with respect to zero level as shown in FIG. 15. Here, as shown in FIG. 16, the system composed of a brush 5, a contact interface B and a photoconductor 1 can be replaced with an equivalent circuit composed of capacities $C_1$, $C_2$ and $C_3$ and resistances $R_1$, $R_2$ and $R_3$. The current can be considered as an a.c.injection current flowing through the capacity elements of the above equivalent circuit. Therefore, the jaggedness of the surface potential generated on photoconductor 1 by the a.c.injection current can be determined by measuring capacity $C_3$ for the photoconductor 1.

In this embodiment, a contact area S between the photoconductor and the brush is 220×5.8 mm², and the photoconductor has a dielectric constant $\epsilon_r$ of 3.13 and a film thickness d of 20 μ2m. And the amplitude of the current is designated by $I_0$ and the frequency of the applied voltage is indicated by f, the varying width ΔV of the surface potential can be expressed as follows:

$$\Delta V = \int_0^{1/f} \{I_0 \cdot \sin\{(2\pi/f)t\}/\epsilon_0 \cdot \epsilon_r \cdot S/d\}dt$$

where $\epsilon_0$ is dielectric constant in vacuum. An actual surface potential can be considered to be −550 V±ΔV/2.

In the way described above, each ΔV/2 was calculated for the conditions 1) through 4), and the Vsp for each condition was determined as follows.

Condition 1): Vsp≈−550±70 V

Condition 2): Vsp≈−550±320 V

Condition 3): Vsp≈−550±60 V

Condition 4): Vsp≈−550±250 V (b) Result of image evaluation

Image evaluation was carried out for each of the aforementioned conditions. As a pattern to be printed an entirely blank image pattern was used, in view of checking stability of the surface potential before light-exposure. In the image forming apparatus used in this embodiment, the surface potential for creating white output image is preferably set at −550 V. If the surface potential is higher than that value, the carrier separation of the developer will be induced. On the other hand, if the surface potential is lower than that value, for example at −500 V, the blank image is found to be developed in a density that can be recognized by the visual observation.

Images printed by the thus adjusted image forming apparatus were evaluated. The evaluation result will be described hereinafter. For the purpose of comparison, also was made evaluation of an image formed by applying a d.c. voltage that will not generate any jaggedness on the surface potential as an a.c. voltage would.

Condition 5): In a case where only a d.c. voltage was applied, unevenness was hardly recognized on the image.

Condition 1): Image unevenness appeared, as shown in FIG. 14, of black lines (shown by BL) extending in a direction perpendicular to the sheet advancing direction. In view of the surface potential figured in the section (a) above, the minimum surface potential can be given as −480 V (=−(550−70)). The width on the photoconductor to which the minimum voltage region corresponds is 262 μm (=52.4(mm/s)/(100(Hz)×2)).

This value is so greater than the least line width (15 μm) which can be developed by the developer (particle size: 15 μm) used in the embodiment that the region of the width (262 μm) can be easily developed. This can be considered to be the cause of the appearance of the black lines. The interval between the black lines BL was in agreement with the interval (Vp/f) of the jaggedness of the surface potential generated on the photoconductor.

Condition 2) : Similar image unevenness to that in the condition 1) was generated in this condition, but the density of the black lines BL previously shown in FIG. 14 was greater. This is because, as understood from the result of (a), the voltage in the region of the image defect is as low as −230 V(=−(550−320)), which is much lower than the voltage in condition 1). To sum up, with the frequency of this a.c. voltage (100 Hz), the greater is the peak-peak value of a.c. voltage, the more noticeable is the jaggedness of the surface potential.

Condition 3): In this condition, the image unevenness appeared as little as the image unevenness appeared in condition 5) where only a d.c. voltage was applied. In view of the result of (a), the minimum surface potential can be given as −490 V (=−(550−60)). The surface potential lowers to a level where the toner-image would appear. However, the width on the photoconductor in which the surface potential falls down to the minimum voltage is 13.1 μm (=52.4(mm/s)/(2000(Hz)×2)) when the applied a.c. voltage is of 2 kHz. This value is smaller than the least line width (15 μm) which can be developed by the developer (particle size: 15 μm) used in the embodiment. This result indicates that in this condition, the jaggedness of the surface potential caused by a.c. voltage has no influence upon the image.

Condition 4) : In this condition, the applied a.c. voltage had a grater peak-peak value than that in condition 3). In view of the result of (a), the minimum surface potential can be given as −300 V (=−(550−250)). The surface potential sufficiently lowers to a level where the toner-image would appear. Nevertheless, also in this condition, an image was obtained as good as that obtained in the condition where only a d.c. voltage was applied. Therefore, it is understood that the jaggedness of the surface potential caused by the a.c. voltage that satisfies the requirement of the present invention will not have influence upon image quality.

Next, another embodiment of the present invention will be described in which a plurality of charging members are used in the aforementioned image forming apparatus shown in FIG. 7B.

Two roller-shaped charging member with a conductive fabric planted thereon was used. The first charging member was applied with a combined voltage of a d.c. voltage of −550 V and an a.c. voltage having a peak-peak value of 1050 V. The second charging member was applied with only a d.c. voltage, which is equal to the d.c. voltage applied to the first charging member, i.e., −550 V. Here, the discharge starting threshold voltage can be calculated based on Paschen's discharge rule, and the thus determined value, −574 V was used as a discharge starting threshold voltage. The surface potential in the thus arranged system, can be determined by following the steps of charging process as follows.

Surface potential V1 generated through the discharge effect by the first charging member:

$$V1=-(550+1050/2)-Vth=(1075-574)=-501\ (V)$$

Surface potential V2 after the charged member has undergone the charge injection through the contact portion with the first charging member:

$$V2=V1\pm\Delta V=-501\pm\Delta V.$$

Here, ΔV represents the ripple component of the surface potential due to the a.c. voltage.

On the other hand, the present inventor investigated a case where a brush-formed charging member 5 on which conductive fibers ("REC", a product of UNITIKA, prepared by dispersing conductive carbon particles into rayon fibers) are planted is brought into contact with photoconductor 1 with a pressing margin (or abutting depth) of 1 mm so as to perform charging. In this case, when an a.c. voltage having a peak-peak value of 1050 V was applied to the brush-formed member in the same condition as for the roller-shaped charging member, the maximum of the injection voltage (ΔV) through the contact portion was confirmed experimentally to be 65 V. Therefore, in the above condition, V2=−501±65 (V) holds. Here, if the development of the image is effected by using the thus charged photoconductor having a surface potential of V2, the portions where V2 takes a minimum value would be toner-developed if the developing bias is set at a certain value. In such a case, black lines BL as shown in FIG. 14 will appear in positions corresponding to the minimum values of V2. Actually, when the developing bias was set at a typical bias value, i.e., −350 V, the portions that would correspond to the minimum of V2 or −436 V appeared as black lines BL that could be recognized by the visual observation.

In contrast with this, in the case of the present invention where the second charging member is provided, the portion charged at V2 by the first charging member, maintaining the voltage, reaches a charging region of the second member. Since the second charging member is applied with d.c. voltage of −550 V, the portion on the photoconductor in which V2 takes the minimum value, i.e., −436 V, has a differential potential of 114 V (=550−436) relative to the second charging member. This potential difference causes charges to be injected from the charging member to the photoconductor through the contact area between the second charging member and the photoconductor, thus increasing the minimum surface potential of the photoconductor. As a result, it is possible to eliminate the black lines BL on the final image which would appear due to the influence of the a.c. voltage at use of a first charging member alone.

As a comparative example, an evaluation image was printed using the first charging member alone as a charging member. In this printing, a combined voltage of a d.c. voltage of −625 and an a.c. voltage (frequency 800 Hz) having a peak-peak value of 900 V was applied. The thus obtained final image included periodically appearing black lines BL, as shown in FIG. 14, caused by the influence of the a.c. voltage.

On the contrary, another evaluation image was printed using a second charging member disposed between the first charging member and the developing unit. In this case, the second charging member was abutted against the photoconductor with a more pressure than that acted on the first charging member, and was applied with the same d.c. voltage (−625 V) as applied to the first charging member. As a result, no black lines BL as shown in FIG. 14 was found in the thus obtained final image as far as it was observed with the naked eye.

Next, another embodiment of the present invention, which were carried out in the image forming apparatus previously shown in FIG. 7A, will be described. In this example, the relation of the occurrence of image unevenness to the charging member that has been used in a long period will be considered in association with the size of conductive fibers used for the charging member and the particle size of toner used. Here, use was made of the equivalent charging member to that described previously in FIGS. 8A and 8B as to the dimensions, configuration and material, etc.

In the thus arranged image forming apparatus, a successive twenty thousand image-printing operation was carried out using each of toners having particle size of 12 μm and 28 μm, respectively. After the operation, it was observed that the toner adhered to the photoconductor for either toner.

In the case where use was made of the toner having a larger size (28 μm) than the diameter of the conductive fiber, image unevenness due to charging ununiformity was observed after 8,000 sheets or thereabouts and variation of density in the image unevenness became large as the prints were repeated. On the other hand, no image unevenness was observed when the toner having a smaller size (12 μm) than the diameter of the conductive fiber was used.

Next, using conductive fibers of 20 μm and 8 μm, respectively, charging members 5 were prepared. With these charging members, the same image forming apparatus as used above was prepared. In this apparatus using the 12 μm-toner, image printing was effected in the same manner. After the operation, adhesion of the toner was observed for either case.

In the case where use was made of the conductive fibers having a smaller diameter (8 μm) than the scale of the toner, image unevenness due to charging ununiformity was observed after 5,000 sheets or thereabout, and variation of density in the image unevenness became large as the prints were repeated. On the other hand, no image unevenness was observed when the conductive fibers having a greater diameter (20 μm) than the scale of the toner was used.

Next, using conductive fibers of 20 μm and 32 μm, respectively, charging members 5 were prepared. With these charging members, the same image forming apparatus as used above was prepared. In this apparatus using the 28 μm-toner, image printing was effected in the same manner. After the operation, adhesion of the toner was observed for either case.

In the case where use was made of the conductive fibers having a smaller diameter (20 μm) than the scale of the toner, image unevenness due to charging ununiformity was observed after 11,000 sheets or thereabout, and variation of density in the image unevenness became large as the prints were repeated. On the other hand, no image unevenness was observed when the conductive fibers having a greater diameter (32 μm) than the scale of the toner was used.

It should be noted that as to the shape of the charging member the roller-type charging member of the present invention is preferable to the brush-type charging member shown in the prior art.

A brush type charger has a simple structure, but is liable to catch toner particles scattered inside the apparatus between fibers and at tips of fibers. This causes the photoconductor to be charged ununiformly, generating possible charging unevenness. Further, since this brush type charger is used such that conductive fibers **5*b* are abutted against photoconductor 1**, an effective area capable of charging the surface of the image bearing medium cannot be taken large and the same face of the charging member is rubbed continuously, so that the fibers are partially worn out. This wear-out may cause charging unevenness, and shorten the life of the fibers.

In contrast with this, in the case of the roller type charger, a large effective area capable of charging the surface of the photoconductor can be taken, and since the charger rotates, neither does any toner form a mass on the charger, or any local worn-out of fibers occur. Accordingly, it is possible to prevent the charging unevenness and lengthen the life of fibers.

In addition, charging member 5 is preferably applied with a varying voltage having a minimum value greater than the discharge starting threshold voltage level. Application of the varying voltage can prevent a localized rise of the surface potential, thus making it possible to charge charged member 1 more uniformly.

Next, as still another embodiment of the present invention, description will be made of controlling means of a charger used in the image forming apparatus previously shown in FIG. 7A.

Figure 17:
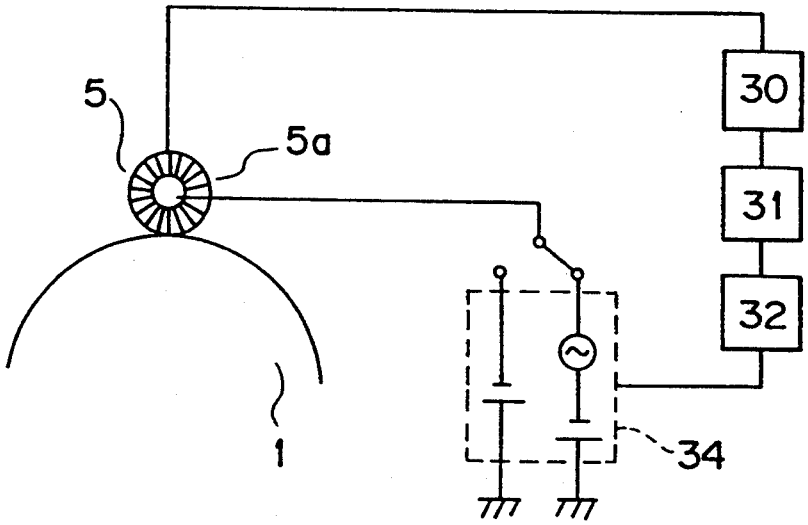
FIG. 17 is a schematic illustrative view showing a configuration of a charging system used in an image forming apparatus shown in FIG. 7A.

FIG. 17 is a schematic illustrative diagram of an arrangement including a charger used in the image forming apparatus. A charging member 5, applied with a voltage from a power source 34 is brought into contact with a photoconductor 1 to charge it at a predetermined voltage. Here, a combined voltage of d.c. and a.c. voltages was applied to the charging member. This is because, charged member 1 can be charged more uniformly by the a.c. superposed voltage than when a d.c. voltage alone is applied.

Conductive fabric cloth **5*a* of a charging member 5 is connected to a detecting circuit 30 for detecting resistance. Based on the resistance value detected by the detection circuit 30, a voltage controlling circuit controls the applied voltage supplied from power source 34. The voltage controlling circuit is composed of a converting circuit 31 and a voltage value selecting circuit 32. Converting circuit 31 convert the resistance value detected by detection circuit 30 into a voltage value information signal, on the basis of which voltage value selecting circuit 32 selects a voltage value applied to the charging member from plural preset voltages. Power source 34 applies the thus selected voltage to the charging member. Here the selection of voltage applied to the charger is made so that charged member 1 may be charged at −600 V, with reference to the data shown in FIG. 18**.

Figure 18:
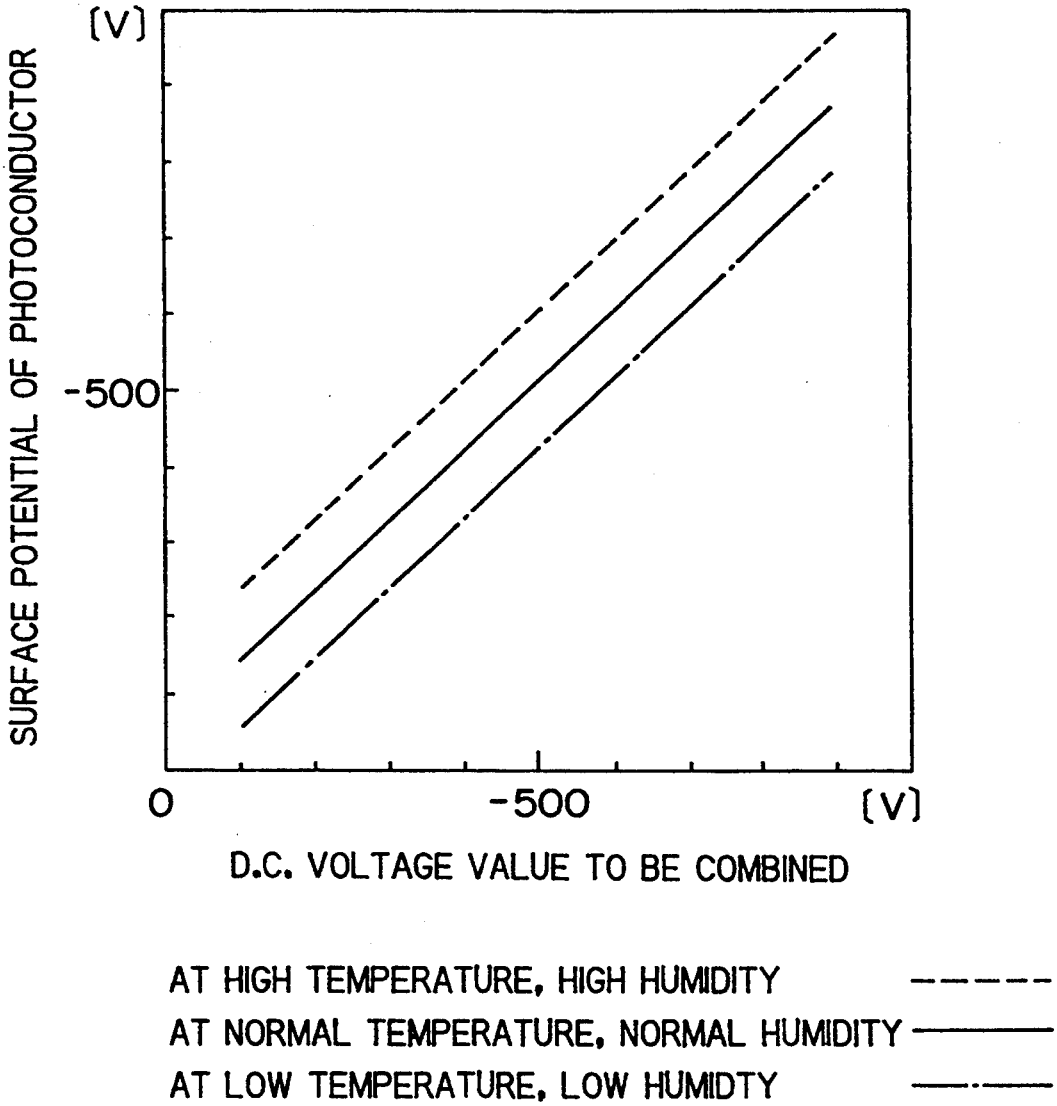
FIG. 18 is a graph for explaining humidity-dependence behavior of the surface potential of a charged member (photoconductor) to the d.c. voltage applied to a charging member of an embodiment of the present invention.

FIG. 18 is a graph for explaining humidity-dependence behavior of the surface potential of charged member 1 to d.c. voltage applied in combination with an a.c. voltage (200 Hz) having a peak-peak value of 900 V to charging member 5. As understood, from the graph, in order to charge the charged member 1 at −600 V, it is necessary to apply d.c. voltages of −600 V, −700 V, −500 V at normal humidity, at low humidity and at high humidity, respectively.

Figure 19:
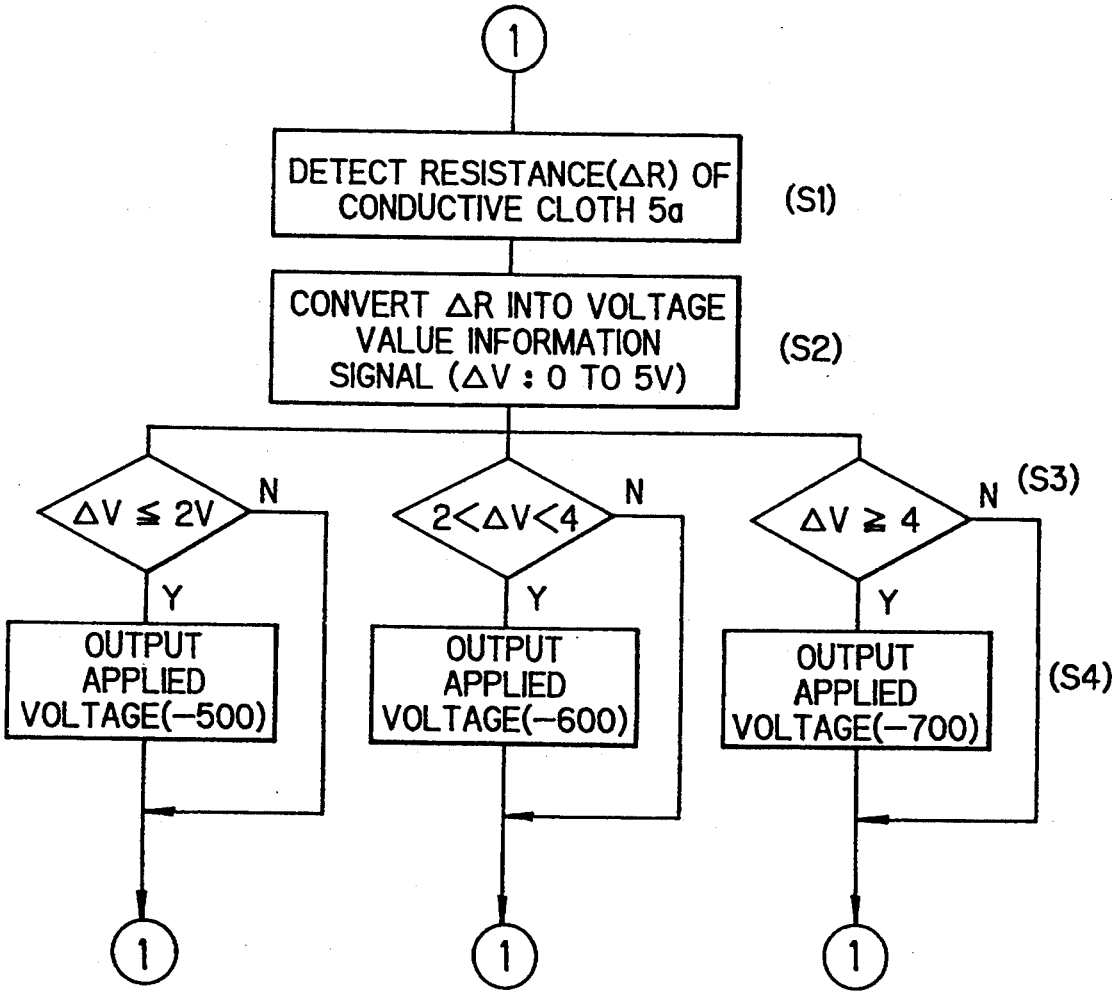
FIG. 19 is a flowchart for explaining a controlling means of a charging device shown in FIG. 17.

With reference to FIG. 19, the aforementioned control of the charging device will be further described in detail.

When no image is formed, a d.c. voltage of −1000 V alone is applied to charging member 5 so that detection circuit 30 detects a varying resistance value ΔR of conductive fabric cloth 5a depending upon the humidity (S1). This result is proper as a reference because charged member 1 will be charged at −600 V when the aforementioned voltage is applied.

The thus detected resistance value ΔR is converted in converting circuit 31, in accordance with its magnitude, into a voltage value information signal ΔV ranging from 0 V to 5 V (S2).

In voltage value selecting circuit 32, there are provided a plurality of preset values of d.c. voltage to be applied in combination with an a.c. voltage to charging member 5 at image-forming. An application voltage is selected from the preset voltages in accordance with the voltage value information signal ΔV sent from converting circuit 31 (S3). For example, −500 V will be selected when ΔV is 2 V or less, −600 V will be selected when ΔV falls within a range of 2 V to 4 V, −700 V will be selected when ΔV is 4 V or more.

The application voltage thus selected in voltage value selecting circuit 32 is outputted from power source 34 (S4).

In this way, in the embodiment of the present invention, a voltage to be applied to charging member 5 is determined every image forming operation by detecting the resistance of charging member 5 in advance before the image forming operation starts. As a result, it is possible to prevent the amount of charges injected into charged member 1 from varying with the humidity, and therefore stabilize the surface potential.

As is apparent from the description, according to the present invention, the following effects can be obtained.

(1) Since the charging member and the charged member (the photoconductor) share a contact area and the charging member is made of a conductive fabric, transfer of charges is effected through the contact area. Further, since a combined voltage of d.c. and a.c. voltages is applied to the charging member, the a.c. voltage component causes the impedance at the contact area to lower, thus promoting the movement of charges and the surface potential of the charged member becomes close to the applied d.c. voltage. As a result, the surface potential can be stabilized under environment varying in temperature and humidity, etc., and a stable surface potential can be maintained in a prolonged period of time.

(2) Since the peak-peak value of the superposed a.c. voltage may be set less than two times of a discharge starting threshold voltage determined by the characteristics of the charged member and the surrounding environment, the power source and its peripheral portions can be reduced in cost.

(3) Since the moving velocity of the surface of the charging member relative to that of the charged member is set up so as not to be zero while the aforementioned combined voltage is applied to the charging member, it is possible to provide high quality images free from line-shaped defects or other unevenness.

(4) In the case where the charging method of the present invention is used, when the frequency f of the applied a.c. voltage is so set up as to suffice the following relation:

$$f > Vp/2R$$

where f is a frequency of the applied a.c. voltage; Vp(mm/s) is a moving velocity of the charged member as a processing speed of the image forming apparatus; and R(mm) is a particle size of a developer used in the image forming apparatus, it is possible to eliminate unevenness on the image.

(5) The application of d.c./a.c. combined voltage can inhibit the change of the surface potential with the passage of time or due to the variation of environment, Further, it is possible to inhibit generation of ozone gas by the direct-contact charging method.

(6) By provision of the secondary charging member or members which are applied with a d.c. voltage on the downstream side of the first charging member, it is possible to eliminate the image unevenness that is caused on the final image by the a.c. voltage component.

(7) A charging method can be provided which enables the charged member to be charged uniformly at any time even if the charged member have the toner adhered after a long use.

(8) A charging method that can inhibit variation of the surface potential on the charged member with the humidity change can be achieved by a charging means utilizing the contact charging process.

What is claimed is:

1. An electrophotographic charging method used for an image forming apparatus including a charging system, wherein said charging system comprises: a charged member; a charging member with a conductive fabric or an aggregation of conductive fibers planted thereon, facing, and abutting against, said charged member so as to create a contact area and micro-space between said charged member and the charging member; and a power source for applying a voltage to said charging member, and charging of said charged member is effected at least through discharge effect via said micro-space and charge injection effect via said contact area, said method comprising the steps of:

generating a combined voltage of d.c. and a.c. voltages in said power source; and applying said combined voltage to said charging member, so that the absolute value of a difference between a surface potential of said charged member and a value of said combined voltage when the absolute value of said combined voltage takes its minimum value is smaller than a discharged starting threshold voltage that is determined by characteristics of said charged member and the atmosphere surrounding the system.

2. An electrophotographic charging method according to claim 1, wherein a peak-peak value of the voltage supplied from said power source is smaller than two times of a discharge starting threshold voltage that is determined by structure of said charged member and the atmosphere surrounding the system.

3. An electrophotographic charging method according to claim 1, wherein said d.c. voltage is equal to a desired surface potential of said charged member, or in a case where other charging member or members are provided, said d.c. voltage is equal to a desired surface potential of said charged member and said d.c. voltage applied to said other charging member or members is equal to or more than the d.c. voltage applied to said charging member.

4. An electrophotographic charging method according to claim 1, wherein a time Tc during which each part of said charged member comes in contact with said charging member in one revolution of said charged member suffices a relation:

$1/f \leqq Tc$ where f is a frequency of said a.c. voltage applied to said charging member.

5. An electrophotographic charging method according to claim 1, wherein said charging member is constructed in a form of a band or roller on which a conductive fabric or an aggregation of fibers is planted.

6. An electrophotographic charging method according to claim 1, wherein said charging member is constructed in a form of a roller on which a conductive fabric or an aggregation of fibers is planted and rotates at a peripheral velocity not equal to a moving velocity of said charged member.

7. An electrophotographic charging method according to claim 1, wherein said charging member is constructed in a form of a band on which a conductive fabric or an aggregation of fibers is planted and vibrates in a direction unparallel to a moving direction of said charged member.

8. An electrophotographic charging method used for an image forming apparatus including a charging system, wherein said charging system comprises: a charged member; a charging member with a conductive fabric or an aggregation of conductive fibers planted thereon, facing, and abutting against, said charged member so as to create a contact area and micro-space between said charged member and said charging member; and a power source for applying a voltage to said charging member, and charging of said charged member is effected at least through discharge effect via said micro-space and charge injection effect via said contact area, said method comprising the steps of:

generating a combined voltage of d.c. and a.c. voltages in said power source; and applying said combined voltage to said charging member, so that a frequency f of said a.c. voltage is so set up as to suffice a relation:

$$f > Vp/2R$$

where f is a frequency of the applied a.c. voltage; VP(mm/s) is a moving velocity of the charged member as a processing speed of said image forming apparatus; and R(mm) is a particle size of a developer used in said image forming apparatus.

9. An electrophotographic charging method used for an image forming apparatus including a charging system, wherein said charging system comprises: a charged member; a charging member with a conductive fabric or an aggregation of conductive fibers planted thereon, facing, and abutting against, said charged member so as to create a contact area and micro-space between said charged member and the charging member; and a power source for applying a voltage to said charging member, and charging of said charged member is effected at least through discharge effect via said micro-space and charge injection effect via said contact area, said method comprising the steps of:

generating a combined voltage of d.c. and a.c. voltages in said power source; and applying said combined voltage to said charging member, so that said voltage applied to said charging member is applied through fibers of the conductive fabric or conductive fibers and is equal to or higher than a discharge starting threshold voltage and the outer diameter, of fibers of the conductive fabric or conductive fibers, is greater than a particle size of a toner particle used.

10. An electrophotographic charging method used for an image forming apparatus including a charging system, wherein said charging system comprises: a charged member; a charging member with a conductive fabric or an aggregation of conductive fibers planted thereon, facing, and abutting against, said charged member so as to create a contact area and micro-space between said charged member and said charging member; and a power source for applying a voltage to said charging member, and charging of said charged member is effected at least through discharge effect via said micro-space and charge injection effect via said contact area, said method comprising the steps of:

generating a combined voltage of d.c. and a.c. voltages in said power source; and applying said combined voltage to said charging member, so that said charging system further comprises: a resistance detecting means for detecting resistance value of said charging member; and a voltage controlling means for controlling said voltage applied to said charging member based on the resistance value detected in said resistance detecting means, and said voltage controlling means comprises a converting means for converting the resistance value detected in said resistance detecting means into a voltage information signal and a voltage selecting means for selecting a voltage to be applied to said charging member from a plurality of preset voltages.

11. An electrophotographic charging method used for an image forming apparatus including a charging system, wherein said charging system comprises: a charged member; a first charging member with a conductive fabric or an aggregation of conductive fibers planted thereon, facing, and abutting against, said charged member so as to create a contact area and micro-space between said charged member and the charging member; and a power source for applying a voltage to said charging member, and charging of said charged member is effected at least through discharge effect via said micro-space and charge injection effect via said contact area, said method comprising the steps of:

generating a combined voltage of d.c. and a.c. voltages in said power source; and applying said combined voltage to said charging member, so that said first charging member is used as a first charging member, and further at least one other charging member or members to which a d.c. voltage is applied are further provided on the down stream side of said charging member.

12. An electrophotographic charging method according to claims 11, wherein, in the case where said other charging member or members are provided, the contact area between said other charging member or members and said charged member is larger than the contact area between said charging member and said charged member.

13. An electrophotographic charging method according to any one of claims 1 through 3, wherein a frequency of said a.c. voltage is so set up as to apply said combined voltage to said charged member oscillating at least in one period of said a.c. voltage within a span of time in which each part of said charged member keeps contact with said charged member.

* * * * *